US008795095B2

(12) United States Patent
Stoker

(10) Patent No.: US 8,795,095 B2
(45) Date of Patent: Aug. 5, 2014

(54) MOTION RIDE METHOD AND APPARATUS FOR ILLUSION OF TELEPORTATION

(71) Applicant: Daniel James Stoker, Tucson, AZ (US)

(72) Inventor: Daniel James Stoker, Tucson, AZ (US)

( * ) Notice: Subject to any disclaimer, the term of this patent is extended or adjusted under 35 U.S.C. 154(b) by 110 days.

(21) Appl. No.: 13/654,940

(22) Filed: Oct. 18, 2012

(65) Prior Publication Data

US 2013/0045811 A1 Feb. 21, 2013

(51) Int. Cl.
*A63G 31/16* (2006.01)
*A63G 7/00* (2006.01)

(52) U.S. Cl.
USPC ..... 472/59; 472/43

(58) Field of Classification Search
USPC ..... 472/43, 59, 60, 83, 130; 434/29, 30, 35, 434/55
See application file for complete search history.

(56) References Cited

U.S. PATENT DOCUMENTS

| | | | | |
|---|---|---|---|---|
| 5,716,281 | A * | 2/1998 | Dote | 472/60 |
| 6,397,755 | B1 * | 6/2002 | Kamler | 104/53 |
| 6,719,563 | B2 * | 4/2004 | Donges | 434/29 |
| 6,910,971 | B2 * | 6/2005 | Alsenz | 472/59 |
| 8,356,966 | B2 * | 1/2013 | Voorhees | 414/676 |
| 2010/0216097 | A1 * | 8/2010 | Romagnoli et al. | 434/35 |

* cited by examiner

*Primary Examiner* — Kien Nguyen

(57) ABSTRACT

A method and apparatus for a motion ride for creating an illusion of teleportation on a multiple of passengers in a ride vehicle. Multiple embodiments of varying apparatus are presented for completing four steps of the method. Passengers observe motion of the passenger vehicle over several environments creating an anticipated location for a perceived final destination of the passenger vehicle following motion through an enclosing structure. The enclosing structure has motion distinct from motion of the passenger vehicle over a predetermined amount of time creating a separation between the actual final destination of the passenger vehicle and the perceived final destination anticipated by passengers. Revealing the actual final destination of the passenger vehicle to passengers creates the effect of the passenger vehicle appearing in a different and unanticipated location instantaneously. The effect can be used for complimenting a story-telling teleportation event of a motion ride.

20 Claims, 25 Drawing Sheets

MOTION RIDE METHOD AND APPARATUS FOR ILLUSION OF TELEPORTATION

REFERENCE TO SEQUENCE LISTING, A TABLE, OR A COMPUTER PROGRAM LISTING COMPACT DISC APPENDIX

Not Applicable

SEQUENCE LISTING

Not Applicable

FIELD OF THE INVENTION

The current invention relates to, but not exclusively, motion rides, dark rides, amusement park attractions, carnival illusions, and themed rides. The current invention also relates to methods and apparatus that aid in creating an illusion of teleportation.

BACKGROUND OF THE INVENTION

The science fiction wonderment of human teleportation has captured the imaginations of millions for centuries. Some of the earliest writings on the concept (for example, Aladdin from The Book of One Thousand and One Nights) provided the first spark for what has turned out to be a long and enduring interest over its technical possibility. Though early scientific studies of the concept offered no solutions, an array of stage illusions fabricated by magicians were developed with great craft and enthusiasm to meet the demands of curious minds. Audiences were treated to such illusions by magicians operating and utilizing trick devices (for example, secret trapdoors or undisclosed identities of twins) in order to manipulate viewers into believing that teleportation had occurred right before their eyes. For years now, performing such acts has been routinely accomplished with the aid of stage actors; however, creating the reverse illusion of convincing an audience that they themselves have been teleported has proved to be a much greater challenge. Furthermore, the landscape of popular audience entertainment in the last century has shifted dramatically away from static auditorium viewing to dynamic motion ride experiences.

Amusement park popularity has exploded over the last century. Early amusement rides, of these parks, explored uses of manufactured background and foreground elements representing exotic locations like a prehistoric land of dinosaurs or the Moon and were often accompanied by varied impulse motions for creating physical sensations of movement. These rides and their modern counterparts, however, assume the task of creating powerful scenery and vehicle accelerations for encouraging passengers to imagine they are traveling to and then in these incredible worlds. In effect, traditional methods and apparatus of modern amusement rides are limited in the full range of ride effects they can ultimately create on passengers, especially in regards to themes of ride journeys of remarkable destinations and fantastic modes of transportation. Consequently, there are few technologies comparable to the current invention.

There is one technology known to the author of the current invention that claims to use a specific method of steps with apparatus to create an illusion of teleportation on a multiple of riders in a ride vehicle. This publication is U.S. Patent Application Publication 20130324271 by Daniel James Stoker. This publication discloses the use of Galilean invariance for a unique four step method that upon completion of all steps of the method with use of apparatus creates an illusion of teleportation on a multiple of riders in a ride vehicle during a motion ride for complimenting a ride theme presenting a teleportation event. The current invention also creates an illusion of teleportation on a multiple of passengers in a ride vehicle to complement a ride theme presenting a teleportation event; however, the mechanism for accomplishing this effect is radically different in regards to the underlying physics utilized. Most notably, the current invention does not use Galilean invariance as described in U.S. Patent Application Publication 20130324271.

In regards to public technologies that do mention teleportation, such publications are not found within fields of motion rides or amusement park attractions, with the exception of the above mentioned, but in fields of video gaming in virtual space (for example, virtual teleportation), magician acts (for example, stage actor teleportation), and physics applications that contain elaborate detailing of scientific principles suggesting the possibility of teleportation by laws of quantum mechanics (for example, quantum entanglement) or general relativity (for example, an Einstein-Rosen bridge).

OBJECTIVES & ADVANTAGES OF THE INVENTION

It was discussed previously that known traditional methods and apparatus of modern amusement rides are limited in the full range of ride effects they can ultimately create on passengers. These rides and their modern counterparts assume the task of creating powerful scenery and vehicle accelerations that encourage passengers to imagine they are traveling to and then in incredible worlds.

The departure from these modern approaches is a radically different approach, presented in the current invention, that moves away from trying to convince passengers that they are traveling to and then in a new destination but rather impart to them the experience that they have traveled to a perceived but false final destination and then reveal to them the actual final destination they have arrived to. With the passengers so heavily invested in believing and anticipating this perceived final destination of the passenger vehicle, from observed motions of the ride vehicle during the motion ride, the sudden presentation of the actual final destination of the passenger vehicle will be almost unbelievable. Passengers will interpret the event as the passenger vehicle being moved instantaneously from the perceived final destination to the actual final destination. This effect can easily be used for complimenting a story-telling element of a ride teleportation event. U.S. patent Application Publication 20130324271 also uses an effect of manipulating passengers into believing that they have arrived to a perceived final destination and then reveals to passengers their actual final destination. As stated previously, the underlying physics for accomplishing this is radically different between U.S. Patent Application Publication 20130324271 and the current invention but the method of the current invention is just as novel, effective, complex, and not obvious in its technology as the method of U.S. Patent Application Publication 20130324271.

Any themed ride could be molded around the effect of the method of the current invention with apparatus for complimenting a science fiction or fantasy teleportation event. This could achieve a story-telling effect of a teleportation event on a multiple of passengers on a motion ride and experiencing a ride theme unrelated or related to popular fiction teleportation as found in literature, television (for example, Doctor Who, Lost, Sliders, Star Trek, Stargate, The Twilight Zone, Wizards of Waverly Place, and Battlestar Galactica), film (for example, Alice in Wonderland, The Black Hole, The Fly, Terminator, Lost in Space, X-Men, Jumper, The Prestige, Timeline, The Hitchhiker 's Guide to the Galaxy, Harry Potter, Monster's Inc., and Marvel's Avengers), and video gaming series (for example, Mario Bros., Legend of Zelda, Call of Duty, Second Life, The Sims, World of Warcraft, and Halo). It would be an entirely new experience, relative to current rides in use today, for any amusement ride enthusiast and for many may even be nearly impossible to explain upon experiencing firsthand as the technical mechanisms behind this effect are complex and not immediately apparent or obvious. It is explained in subsequent sections how creating an illusion of teleportation in the current invention relies on a four step method that uses variably changing positions and velocities of motion ride structures, relative to variably changing velocities and positions of passenger vehicles, for separating locations of perceived final destinations and actual final destinations of passenger vehicles while multiple passengers in the passenger vehicles move through motion rides.

SUMMARY OF THE INVENTION

The current invention is a four step method and apparatus for a motion ride that creates an illusion of teleportation on a multiple of passengers in a passenger vehicle. Multiple embodiments of diverse type and use of apparatus are presented for completing the four steps of the method. The first step is moving a passenger vehicle carrying at least one of a passenger by a first means through a primary environment, the primary environment in the field of vision of least one of the passenger and the primary environment being an environment external to and surrounding a secondary environment. The second step is moving the passenger vehicle carrying least one of the passenger by the first means out of the primary environment and into an opaque enclosing structure by access of at least one of multiple of an opaque movable door of the enclosing structure, the secondary environment being the environment inside of the enclosing structure. The third step is moving the enclosing structure by a second means for a predetermined amount of time with at least one of a predetermined structural velocity while the passenger vehicle carrying least one of the passenger by the first means has at least one of a predetermined vehicular velocity not equal to least one predetermined structural velocity during the predetermined amount of time, the primary environment not in the field of vision of least one of the passenger and the secondary environment in the field of vision of least one of the passenger. The fourth step is moving the passenger vehicle carrying least one of the passenger by the first means out of the secondary environment and into the primary environment by access of at least one of multiple of the movable door of the enclosing structure, the primary environment in the field of vision of least one of the passenger.

One of the strongest advantages of the current invention over any other publicly known technology is the unique and highly effective four step method of the current invention for creating an illusion of teleportation on a multiple of passengers in a passenger vehicle. This is further indicated by a complete lack of finding of the four steps of the method of the current invention in any other public technologies to date. Such a lack of finding of these four steps of the method of the current invention verifies that no other technology creates these same synergistic effects resulting from the manner of use of the differentiated velocities and positions of passenger vehicles and enclosing structures with selectively hidden positions and velocities of specific environments and structures throughout the four steps of the method as described in the multiple embodiments of the current invention.

ELEMENTS AND DESCRIPTION

Figure 1:
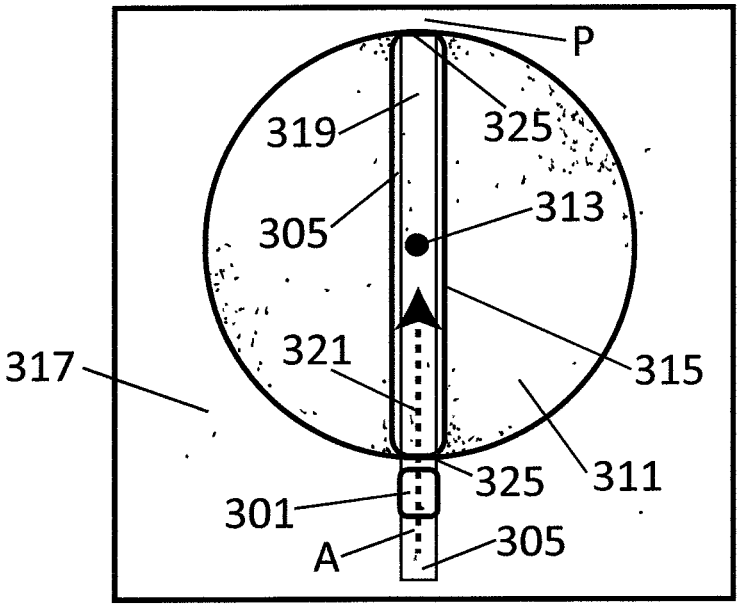
FIG. 1 is an aerial view of part of a motion ride for a first embodiment of the current invention during the first of four steps of the method of the current invention for creating an illusion of teleportation.

Table of Element Numbers, Element Characters, and Element Descriptions

Element Number/Character Element Description

A Actual final destination
P Perceived final destination
K Apparatus of first embodiment
301 Passenger vehicle
303 Viewing screen
305 Ride track
307 Viewing panel
309 Passenger
311 Rotating platform
313 Central axis
315 Enclosing structure
317 Primary environment
319 Secondary environment
321 Vehicular velocity
323 Angular structural velocity
325 Movable door
327 Unloading and loading station
329 Shifting platform structural velocity
331 Suspended platform structural velocity
333 Shifting platform
335 Suspended platform
337 Platform cable
339 Platform rotating motor
341 Rotating and suspended platform
345 Platform shifting motor
349 Ride FIG.
401 First step of the method of the current invention
403 Second step of the method of the current invention
405 Third step of the method of the current invention
407 Fourth step of the method of the current invention

DETAILED DESCRIPTION OF THE PREFERRED EMBODIMENTS

Some of the figures showing apparatus have a minor number of structures being transparent so to allow viewing of other elements. The transparent structures present for each embodiment of the current invention are identified by parentheses following the first mention of the transparent element and holding content of "transparent as shown." This transparency applies to structures that enclose riders during the motion ride and doors that act as access points for entering and exiting these structures that enclose riders. In the case of the doors, everything is transparent but the edges of the door that outline the boundaries and shape of the door. In the case of the structures that enclose riders, everything is transparent but the edges of the structure that outline the boundaries and shape of the structure. Objects in front of, or attached to, any of these transparent elements are not transparent. It should be noted that these transparent elements in the drawings are not transparent in actual use of the current invention. Structures that enclose riders in the third step of the method of the current invention, including doors, must be non-transparent to riders so that the environment outside of the structure that is enclosing riders cannot be seen. This also means that adequate lighting, or other methods of illumination, must be present within the structure enclosing riders. And while there is nearly an unlimited number of ways to illuminate a room, a few possibilities are addressed in FIGS. 21, 22, 23, 24, 25, 26, 27, 28, 29 and 30. The rest of the figures are focused primarily on the mechanics of the four steps of the method and do not address lighting issues so as not to detract from understanding of the method.

Vectors of velocities of objects are identified as dashed lines with lead arrows. The lead arrow of a dashed line indicates the direction of the velocity vector. Structures that have boundaries with dashed lines and no lead arrows are structures that have moved as the result of at least one velocity vector. It is believed that this presentation of the drawings is the most effective manner for showing the essential method of the current invention with varying apparatus used for six embodiments of the current invention. In FIGS. 1, 2, 3, 4, 5, 6, 7, 8, 9, 10, 11, 12, 31, 32, 33, 34, 35, 36, 37, 38, 39, 40, 41, 42, 43, 44, 45, and 46, apparatus for varying embodiments of the current invention are shown without riders in the vehicles so mechanical functioning of apparatus and steps of the method of the current invention can be primarily analyzed. Riders are included in FIGS. 13, 14, 15, 16, 17, 18, 19, 20, 21, 22, 23, 24, 25, 26, 27, 28, 29, 30, 47, 48, and 49 for viewing of riders and their experiences during motion rides.

FIG. 1 is an aerial view of part of a motion ride for a first embodiment of the current invention during the first of four steps of the method of the current invention for creating an illusion of teleportation. A passenger vehicle 301 is in a primary environment 317 and beginning to move over a ride track 305 and into an enclosing structure 315 (shown as transparent). Passenger vehicle 301 has a vehicular velocity 321. Enclosing structure 315 has the shape of a tubular passageway that connects to a rotating platform 311. Enclosing structure 315 has multiple of a movable door 325 (shown as transparent) on the ends of the tubular passageway shape. Multiple of movable door 325 can open and close at edges of rotating platform 311 where ride track 305 connects and disconnects to rotating platform 311 as a connecting and disconnecting ride track. A secondary environment 319 is the environment inside enclosing structure 315. Primary environment 317 is located external to secondary environment 319. Rotating platform 311 has capability to rotate around a central axis 313. A perceived final destination P is identified as an area where riders of passenger vehicle 301 are anticipating is their final destination based upon their perceived motion through the motion ride. An actual final destination A is identified as an area where riders of passenger vehicle 301 actually arrive in contrast to their perceived motion through the motion ride.

Figure 2:
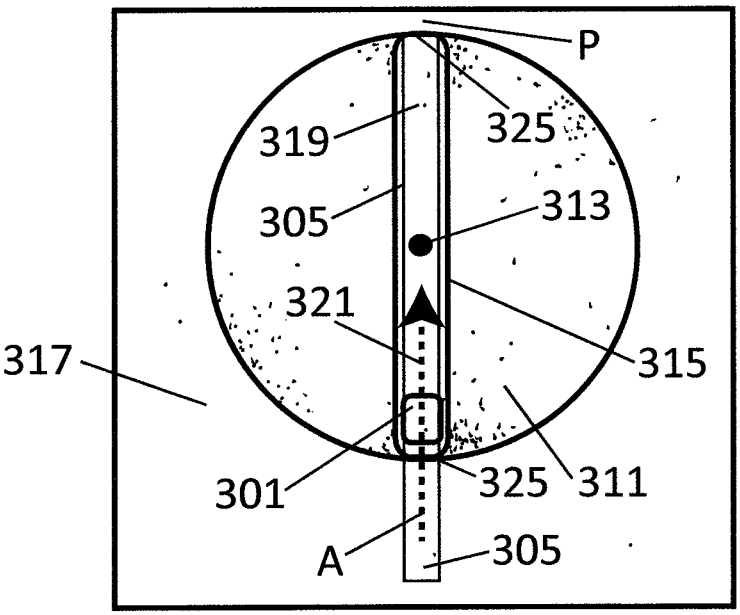
FIG. 2 is an aerial view of part of a motion ride for a first embodiment of the current invention during the second of four steps of the method of the current invention for creating an illusion of teleportation.

FIG. 2 is an aerial view of part of a motion ride for a first embodiment of the current invention during the second of four steps of the method of the current invention for creating an illusion of teleportation. Passenger vehicle 301 has entered secondary environment 319 and is moving over ride track 305 and through enclosing structure 315. Passenger vehicle 301 has vehicular velocity 321. Enclosing structure 315 has the shape of a tubular passageway that connects to rotating platform 311. Enclosing structure 315 has multiple of movable door 325 on the ends of the tubular passageway shape. Multiple of movable door 325 can open and close at edges of rotating platform 311 where ride track 305 connects and disconnects to rotating platform 311 as a connecting and disconnecting ride track. Secondary environment 319 is the environment inside enclosing structure 315. Primary environment 317 is located external to secondary environment 319. Movable door 325 that passenger vehicle 301 has passed through has closed to visually encapsulate passenger vehicle 301 inside enclosing structure 315. Rotating platform 311 has capability to rotate around central axis 313. Perceived final destination P is identified as an area where riders of passenger vehicle 301 are anticipating is their final destination based upon their perceived motion through the motion ride. Actual final destination A is identified as an area where riders of passenger vehicle 301 actually arrive in contrast to their perceived motion through the motion ride.

Figure 3:
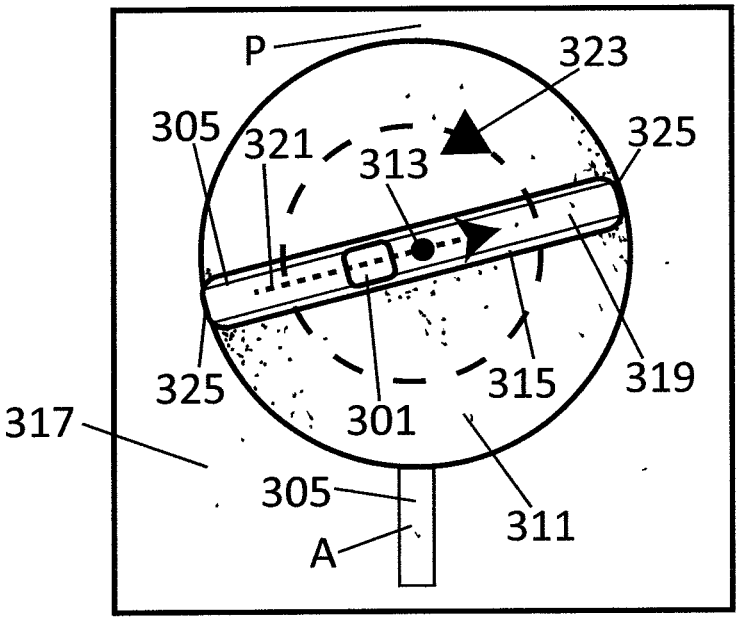
FIG. 3 is an aerial view of part of a motion ride for a first embodiment of the current invention during the third of four steps of the method of the current invention for creating an illusion of teleportation.
Figure 4:
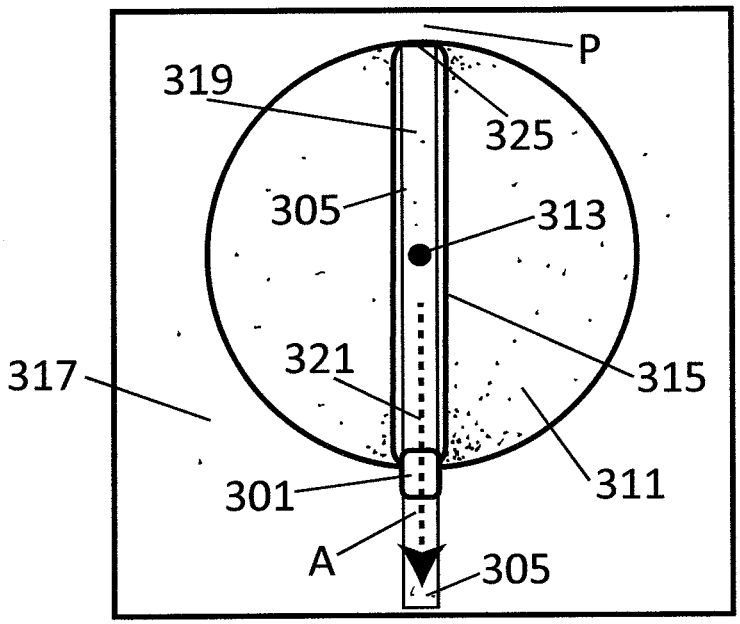
FIG. 4 is an aerial view of part of a motion ride for a first embodiment of the current invention during the fourth of four steps of the method of the current invention for creating an illusion of teleportation.

FIG. 3 is an aerial view of part of a motion ride for a first embodiment of the current invention during the third of four steps of the method of the current invention for creating an illusion of teleportation. Passenger vehicle 301 is in secondary environment 319 and is moving over ride track 305 and through enclosing structure 315. Passenger vehicle 301 has vehicular velocity 321. Enclosing structure 315 has the shape of a tubular passageway that connects to rotating platform 311 and is moving with an angular structural velocity 323. Enclosing structure 315 has multiple of movable door 325 on the ends of the tubular passageway shape. Multiple of movable door 325 can open and close at edges of rotating platform 311 where ride track 305 connects and disconnects to rotating platform 311 as a connecting and disconnecting ride track. Secondary environment 319 is the environment inside enclosing structure 315. Primary environment 317 is located external to secondary environment 319. Movable door 325 that passenger vehicle 301 previously passed through is closed to visually encapsulate passenger vehicle 301 inside enclosing structure 315. Rotating platform 311 has capability to rotate around central axis 313 and is rotating around central axis 313 with angular velocity 323. Perceived final destination P is identified as an area where riders of passenger vehicle 301 are anticipating is their final destination based upon their perceived motion through the motion ride. Actual final destination A is identified as an area where riders of passenger vehicle 301 actually arrive in contrast to their perceived motion through the motion ride.

FIG, 4 is an aerial view of part of a motion ride for a first embodiment of the current invention during the fourth of four steps of the method of the current invention for creating an illusion of teleportation. Passenger vehicle 301 is leaving secondary environment 319 and is moving over ride track 305 and into primary environment 317. Passenger vehicle 301 has vehicular velocity 321. Enclosing structure 315 has the shape of a tubular passageway that connects to rotating platform 311. Enclosing structure 315 has multiple of movable door 325 on the ends of the tubular passageway shape. Multiple of movable door 325 can open and close at edges of rotating platform 311 where ride track 305 connects and disconnects to rotating platform 311 as a connecting and disconnecting ride track. Secondary environment 319 is the environment inside enclosing structure 315. Primary environment 317 is located external to secondary environment 319. Movable door 325 that passenger vehicle 301 is passing through is open. Rotating platform 311 has capability to rotate around central axis 313. Perceived final destination P is identified as an area where riders of passenger vehicle 301 are anticipating is their fmal destination based upon their perceived motion through the motion ride. Actual final destination A is identified as an area where riders of passenger vehicle 301 actually arrive in contrast to their perceived motion through the motion ride.

Figure 5:
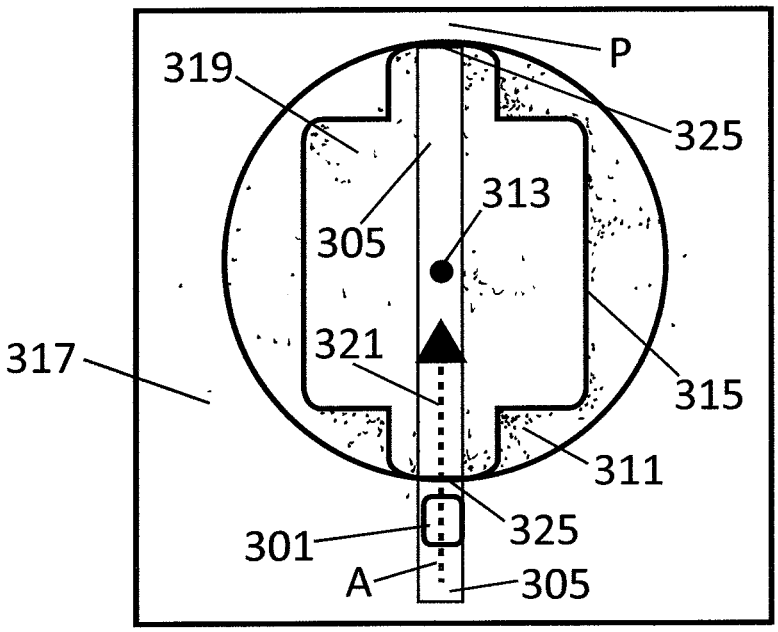
FIG. 5 is an aerial view of part of a motion ride for a second embodiment of the current invention during the first of four steps of the method of the current invention for creating an illusion of teleportation.

FIG. 5 is an aerial view of part of a motion ride for a second embodiment of the current invention during the first of four steps of the method of the current invention for creating an illusion of teleportation. A passenger vehicle 301 is in a primary environment 317 and beginning to move over a ride track 305 and into an enclosing structure 315 (shown as transparent). Passenger vehicle 301 has a vehicular velocity 321. Enclosing structure 315 has the shape of a cross passageway that connects to a rotating platform 311. Enclosing structure 315 has multiple of a movable door 325 (shown as transparent) on the ends of the cross passageway shape. Multiple of movable door 325 can open and close at edges of rotating platform 311 where ride track 305 connects and disconnects to rotating platform 311 as a connecting and disconnecting ride track. A secondary environment 319 is the environment inside enclosing structure 315. Primary environment 317 is located external to secondary environment 319. Rotating platform 311 has capability to rotate around a central axis 313. A perceived final destination P is identified as an area where riders of passenger vehicle 301 are anticipating is their final destination based upon their perceived motion through the motion ride. An actual final destination A is identified as an area where riders of passenger vehicle 301 actually arrive in contrast to their perceived motion through the motion ride.

Figure 6:
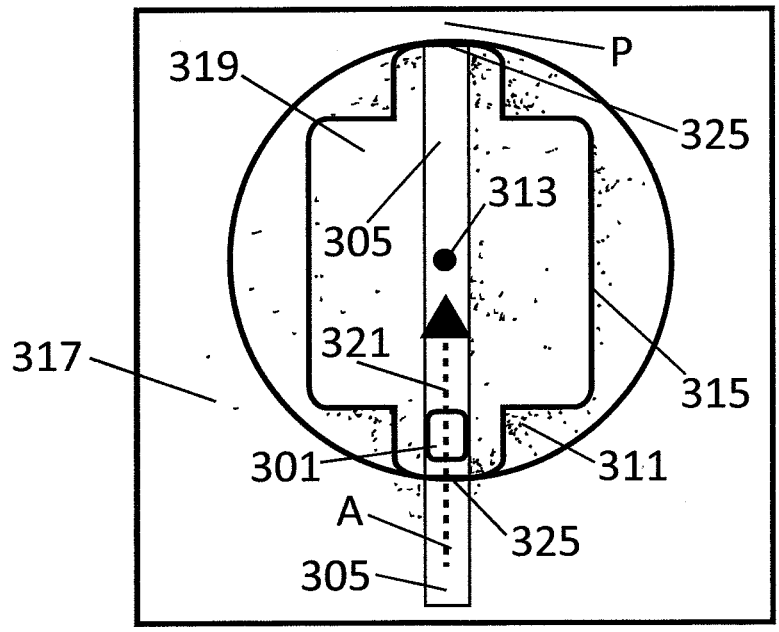
FIG. 6 is an aerial view of part of a motion ride for a second embodiment of the current invention during the second of four steps of the method of the current invention for creating an illusion of teleportation.

FIG. 6 is an aerial view of part of a motion ride for a second embodiment of the current invention during the second of four steps of the method of the current invention for creating an illusion of teleportation. Passenger vehicle 301 has entered secondary environment 319 and is moving over ride track 305 and through enclosing structure 315. Passenger vehicle 301 has vehicular velocity 321. Enclosing structure 315 has the shape of a cross passageway that connects to rotating platform 311. Enclosing structure 315 has multiple of movable door 325 on the ends of the cross passageway shape. Multiple of movable door 325 can open and close at edges of rotating platform 311 where ride track 305 connects and disconnects to rotating platform 311 as a connecting and disconnecting ride track. Secondary environment 319 is the environment inside enclosing structure 315. Primary environment 317 is located external to secondary environment 319. Movable door 325 that passenger vehicle 301 has passed through has closed to visually encapsulate passenger vehicle 301 inside enclosing structure 315. Rotating platform 311 has capability to rotate around central axis 313. Perceived final destination P is identified as an area where riders of passenger vehicle 301 are anticipating is their final destination based upon their perceived motion through the motion ride. Actual final destination A is identified as an area where riders of passenger vehicle 301 actually arrive in contrast to their perceived motion through the motion ride.

Figure 7:
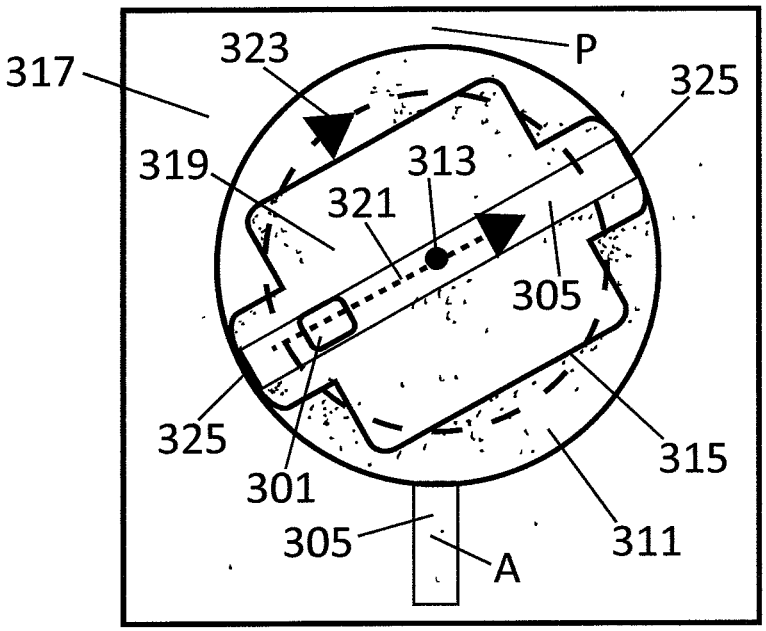
FIG. 7 is an aerial view of part of a motion ride for a second embodiment of the current invention during the third of four steps of the method of the current invention for creating an illusion of teleportation.

FIG. 7 is an aerial view of part of a motion ride for a second embodiment of the current invention during the third of four steps of the method of the current invention for creating an illusion of teleportation. Passenger vehicle 301 is in secondary environment 319 and is moving over ride track 305 and through enclosing structure 315. Passenger vehicle 301 has vehicular velocity 321. Enclosing structure 315 has the shape of a cross passageway that connects to rotating platform 311 and is moving with an angular structural velocity 323. Enclosing structure 315 has multiple of movable door 325 on the ends of the cross passageway shape. Multiple of movable door 325 can open and close at edges of rotating platform 311 where ride track 305 connects and disconnects to rotating platform 311 as a connecting and disconnecting ride track. Secondary environment 319 is the environment inside enclosing structure 315. Primary environment 317 is located external to secondary environment 319. Movable door 325 that passenger vehicle 301 previously passed through is closed to visually encapsulate passenger vehicle 301 inside enclosing structure 315. Rotating platform 311 has capability to rotate around central axis 313 and is rotating around central axis 313 with angular velocity 323. Perceived final destination P is identified as an area where riders of passenger vehicle 301 are anticipating is their final destination based upon their perceived motion through the motion ride. Actual final destination A is identified as an area where riders of passenger vehicle 301 actually arrive in contrast to their perceived motion through the motion ride.

Figure 8:
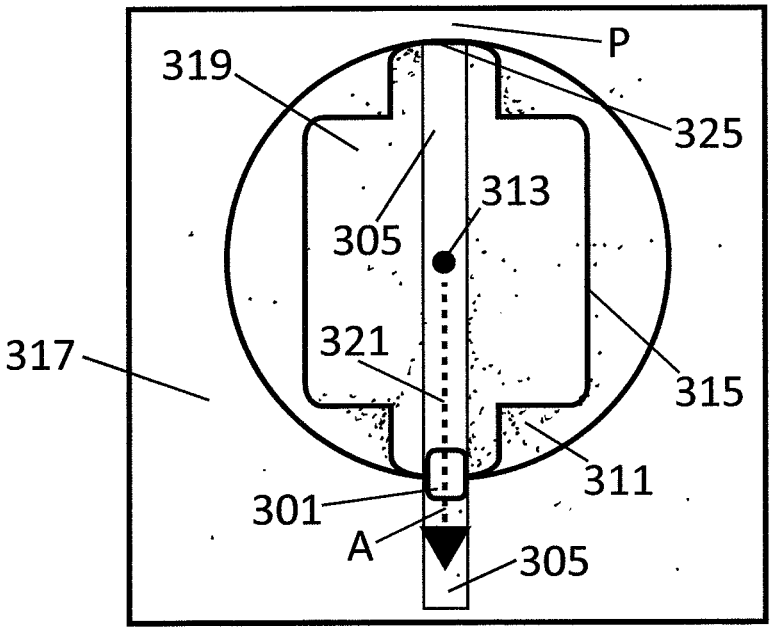
FIG. 8 is an aerial view of part of a motion ride for a second embodiment of the current invention during the fourth of four steps of the method of the current invention for creating an illusion of teleportation.

FIG. 8 is an aerial view of part of a motion ride for a second embodiment of the current invention during the fourth of four steps of the method of the current invention for creating an illusion of teleportation. Passenger vehicle 301 is leaving secondary environment 319 and is moving over ride track 305 and into primary environment 317. Passenger vehicle 301 has vehicular velocity 321. Enclosing structure 315 has the shape of a cross passageway that connects to rotating platform 311. Enclosing structure 315 has multiple of movable door 325 on the ends of the cross passageway shape. Multiple of movable door 325 can open and close at edges of rotating platform 311 where ride track 305 connects and disconnects to rotating platform 311 as a connecting and disconnecting ride track. Secondary environment 319 is the environment inside enclosing structure 315. Primary environment 317 is located external to secondary environment 319. Movable door 325 that passenger vehicle 301 is passing through is open. Rotating platform 311 has capability to rotate around central axis 313. Perceived final destination P is identified as an area where riders of passenger vehicle 301 are anticipating is their final destination based upon their perceived motion through the motion ride. Actual final destination A is identified as an area where riders of passenger vehicle 301 actually arrive in contrast to their perceived motion through the motion ride.

Figure 9:
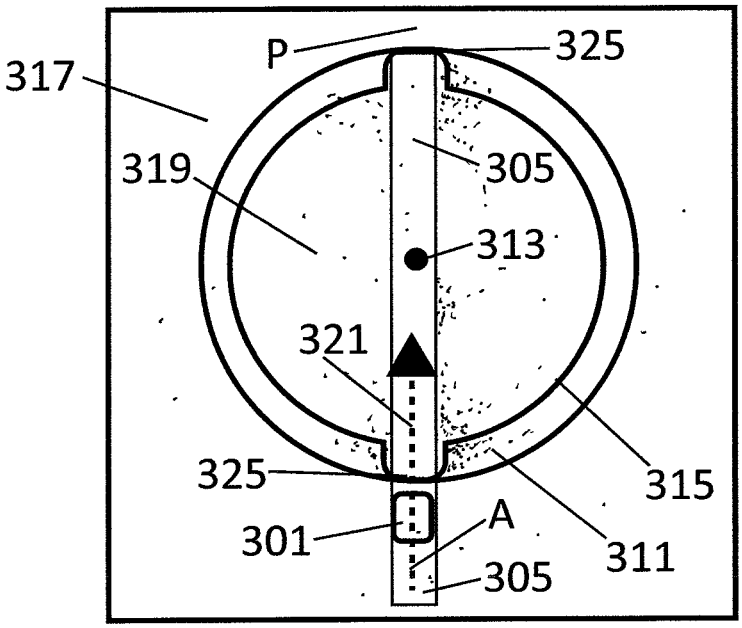
FIG. 9 is an aerial view of part of a motion ride for a third embodiment of the current invention during the first of four steps of the method of the current invention for creating an illusion of teleportation.

FIG. 9 is an aerial view of part of a motion ride for a third embodiment of the current invention during the first of four steps of the method of the current invention for creating an illusion of teleportation. A passenger vehicle 301 is in a primary environment 317 and beginning to move over a ride track 305 and into an enclosing structure 315 (shown as transparent). Passenger vehicle 301 has a vehicular velocity 321. Enclosing structure 315 has the shape of an elliptical passageway that connects to a rotating platform 311. Enclosing structure 315 has multiple of a movable door 325 (shown as transparent) on the ends of the elliptical passageway shape. Multiple of movable door 325 can open and close at edges of rotating platform 311 where ride track 305 connects and disconnects to rotating platform 311 as a connecting and disconnecting ride track. A secondary environment 319 is the environment inside enclosing structure 315. Primary environment 317 is located external to secondary environment 319. Rotating platform 311 has capability to rotate around a central axis 313. A perceived final destination P is identified as an area where riders of passenger vehicle 301 are anticipating is their final destination based upon their perceived motion through the motion ride. An actual final destination A is identified as an area where riders of passenger vehicle 301 actually arrive in contrast to their perceived motion through the motion ride.

Figure 10:
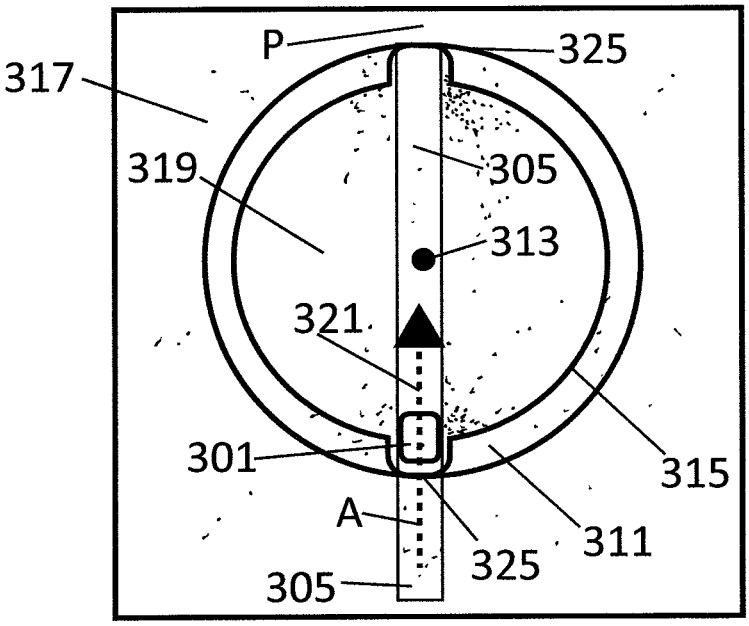
FIG. 10 is an aerial view of part of a motion ride for a third embodiment of the current invention during the second of four steps of the method of the current invention for creating an illusion of teleportation.

FIG. 10 is an aerial view of part of a motion ride for a third embodiment of the current invention during the second of four steps of the method of the current invention for creating an illusion of teleportation. Passenger vehicle 301 has entered secondary environment 319 and is moving over ride track 305 and through enclosing structure 315. Passenger vehicle 301 has vehicular velocity 321. Enclosing structure 315 has the shape of an elliptical passageway that connects to rotating platform 311. Enclosing structure 315 has multiple of movable door 325 on the ends of the elliptical passageway shape. Multiple of movable door 325 can open and close at edges of rotating platform 311 where ride track 305 connects and disconnects to rotating platform 311 as a connecting and disconnecting ride track. Secondary environment 319 is the environment inside enclosing structure 315. Primary environment 317 is located external to secondary environment 319. Movable door 325 that passenger vehicle 301 has passed through has closed to visually encapsulate passenger vehicle 301 inside enclosing structure 315. Rotating platform 311 has capability to rotate around central axis 313. Perceived final destination P is identified as an area where riders of passenger vehicle 301 are anticipating is their final destination based upon their perceived motion through the motion ride. Actual final destination A is identified as an area where riders of passenger vehicle 301 actually arrive in contrast to their perceived motion through the motion ride.

Figure 11:
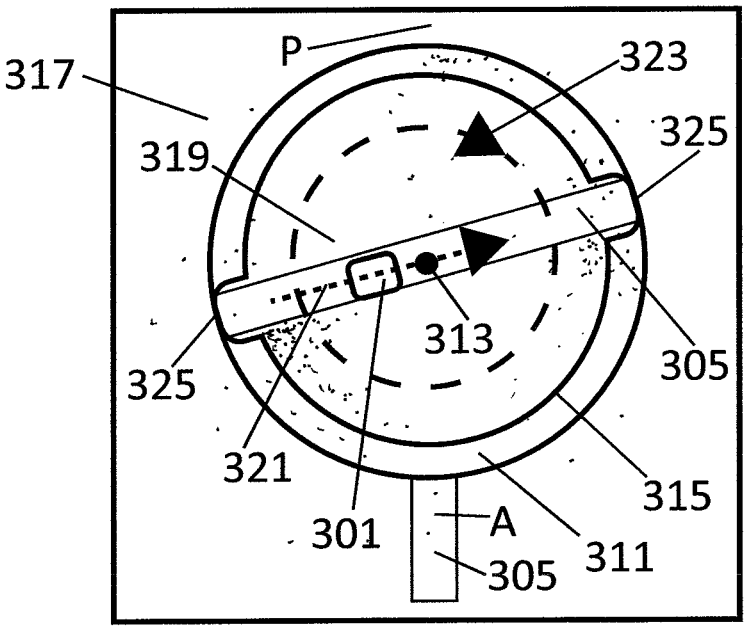
FIG. 11 is an aerial view of part of a motion ride for a third embodiment of the current invention during the third of four steps of the method of the current invention for creating an illusion of teleportation.

FIG. 11 is an aerial view of part of a motion ride for a third embodiment of the current invention during the third of four steps of the method of the current invention for creating an illusion of teleportation. Passenger vehicle 301 is in secondary environment 319 and is moving over ride track 305 and through enclosing structure 315. Passenger vehicle 301 has vehicular velocity 321. Enclosing structure 315 has the shape of an elliptical passageway that connects to rotating platform 311 and is moving with an angular structural velocity 323. Enclosing structure 315 has multiple of movable door 325 on the ends of the elliptical passageway shape. Multiple of movable door 325 can open and close at edges of rotating platform 311 where ride track 305 connects and disconnects to rotating platform 311 as a connecting and disconnecting ride track. Secondary environment 319 is the environment inside enclosing structure 315. Primary environment 317 is located external to secondary environment 319. Movable door 325 that passenger vehicle 301 previously passed through is closed to visually encapsulate passenger vehicle 301 inside enclosing structure 315. Rotating platform 311 has capability to rotate around central axis 313 and is rotating around central axis 313 with angular velocity 323. Perceived final destination P is identified as an area where riders of passenger vehicle 301 are anticipating is their final destination based upon their perceived motion through the motion ride. Actual final destination A is identified as an area where riders of passenger vehicle 301 actually arrive in contrast to their perceived motion through the motion ride.

Figure 12:
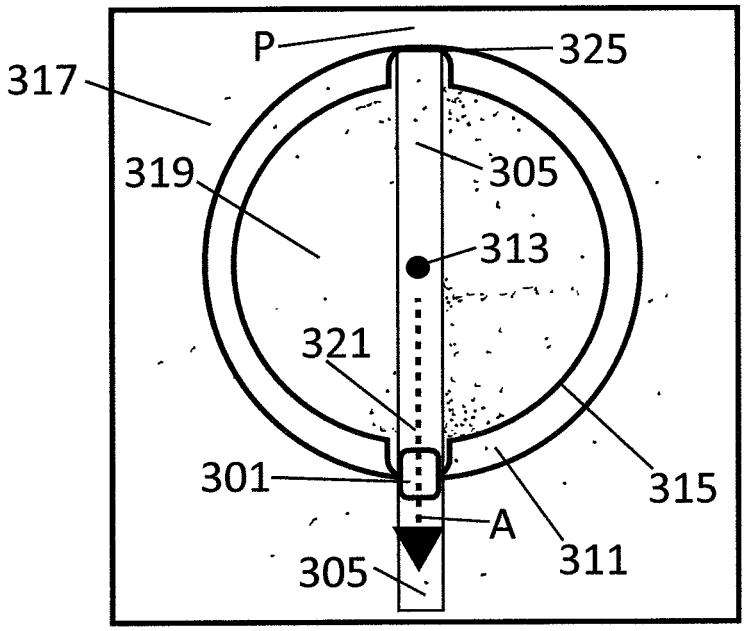
FIG. 12 is an aerial view of part of a motion ride for a third embodiment of the current invention during the fourth of four steps of the method of the current invention for creating an illusion of teleportation.

FIG. 12 is an aerial view of part of a motion ride for a third embodiment of the current invention during the fourth of four steps of the method of the current invention for creating an illusion of teleportation. Passenger vehicle 301 is leaving secondary environment 319 over ride track 305 and is moving into primary environment 317. Passenger vehicle 301 has vehicular velocity 321. Enclosing structure 315 has the shape of an elliptical passageway that connects to rotating platform 311. Enclosing structure 315 has multiple of movable door 325 on the ends of the elliptical passageway shape. Multiple of movable door 325 can open and close at edges of rotating platform 311 where ride track 305 connects and disconnects to rotating platform 311 as a connecting and disconnecting ride track. Secondary environment 319 is the environment inside enclosing structure 315. Primary environment 317 is located external to secondary environment 319. Movable door 325 that passenger vehicle 301 is passing through is open. Rotating platform 311 has capability to rotate around central axis 313. Perceived final destination P is identified as an area where riders of passenger vehicle 301 are anticipating is their final destination based upon their perceived motion through the motion ride. Actual final destination A is identified as an area where riders of passenger vehicle 301 actually arrive in contrast to their perceived motion through the motion ride.

Figure 13:
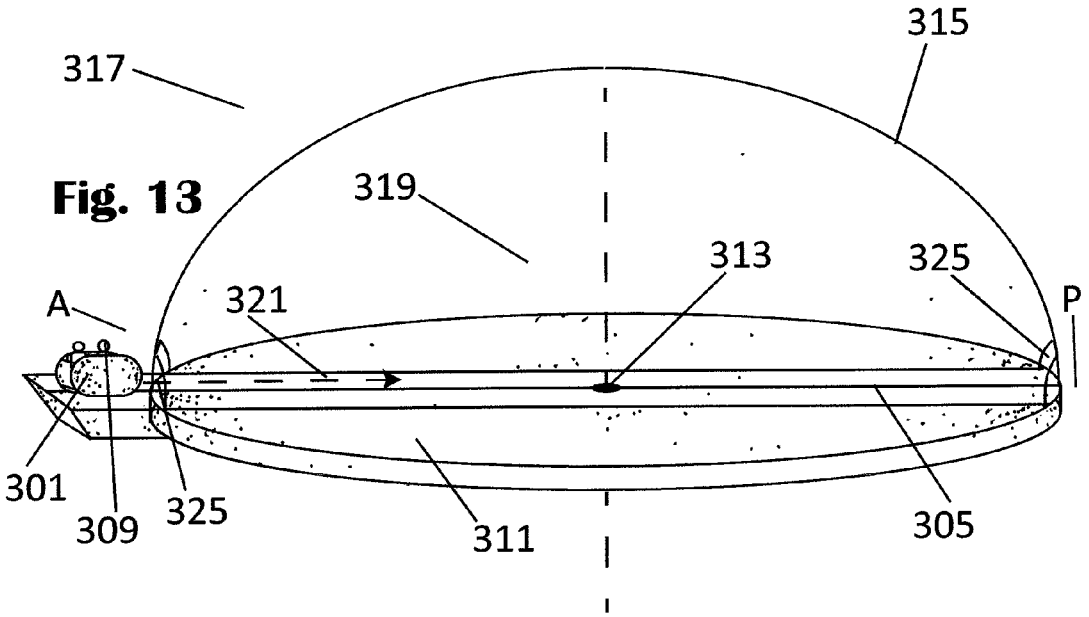
FIG. 13 is a side view of part of a motion ride for a third embodiment of the current invention during the first of four steps of the method of the current invention for creating an illusion of teleportation.

FIG. 13 is a side view of part of a motion ride for a third embodiment of the current invention during the first of four steps of the method of the current invention for creating an illusion of teleportation. Passenger vehicle 301 is in primary environment 317 carrying multiple of a passenger 309 over ride track 305 and beginning to move into enclosing structure 315. Passenger vehicle 301 has vehicular velocity 321. Enclosing structure 315 has the shape of an elliptical passageway that connects to rotating platform 311. Enclosing structure 315 has multiple of movable door 325 on the ends of the elliptical passageway shape. Multiple of movable door 325 can open and close at edges of rotating platform 311 where ride track 305 connects and disconnects to rotating platform 311 as a connecting and disconnecting ride track. Secondary environment 319 is the environment inside enclosing structure 315. Primary environment 317 is located external to secondary environment 319. Rotating platform 311 has capability to rotate around central axis 313. Perceived final destination P is identified as an area where riders of passenger vehicle 301 are anticipating is their final destination based upon their perceived motion through the motion ride. Actual final destination A is identified as an area where riders of passenger vehicle 301 actually arrive in contrast to their perceived motion through the motion ride.

Figure 14:
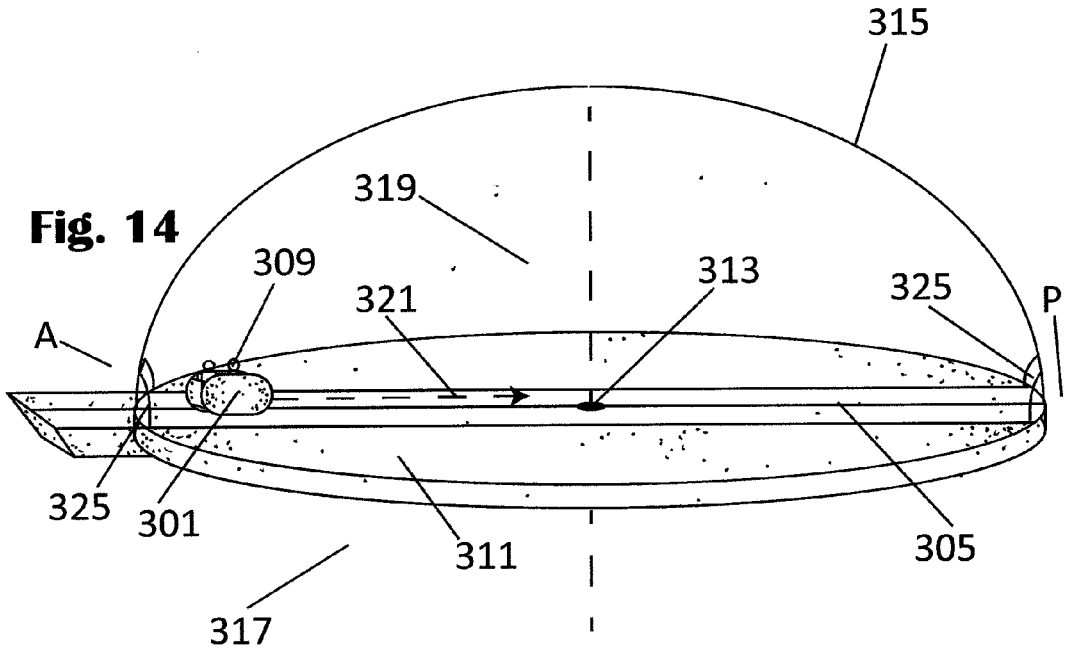
FIG. 14 is a side view of part of a motion ride for a third embodiment of the current invention during the second of four steps of the method of the current invention for creating an illusion of teleportation.

FIG. 14 is a side view of part of a motion ride for a third embodiment of the current invention during the second of four steps of the method of the current invention for creating an illusion of teleportation. Passenger vehicle 301 has entered secondary environment 319 and is carrying multiple of passenger 309 over ride track 305 and through enclosing structure 315. Passenger vehicle 301 has vehicular velocity 321. Enclosing structure 315 has the shape of an elliptical passageway that connects to rotating platform 311. Enclosing structure 315 has multiple of movable door 325 on the ends of the elliptical passageway shape. Multiple of movable door 325 can open and close at edges of rotating platform 311 where ride track 305 connects and disconnects to rotating platform 311 as a connecting and disconnecting ride track. Secondary environment 319 is the environment inside enclosing structure 315. Primary environment 317 is located external to secondary environment 319. Movable door 325 that passenger vehicle 301 has passed through has closed to visually encapsulate passenger vehicle 301 inside enclosing structure 315. Rotating platform 311 has capability to rotate around central axis 313. Perceived final destination P is identified as an area where riders of passenger vehicle 301 are anticipating is their fmal destination based upon their perceived motion through the motion ride. Actual fmal destination A is identified as an area where riders of passenger vehicle 301 actually arrive in contrast to their perceived motion through the motion ride.

Figure 15:
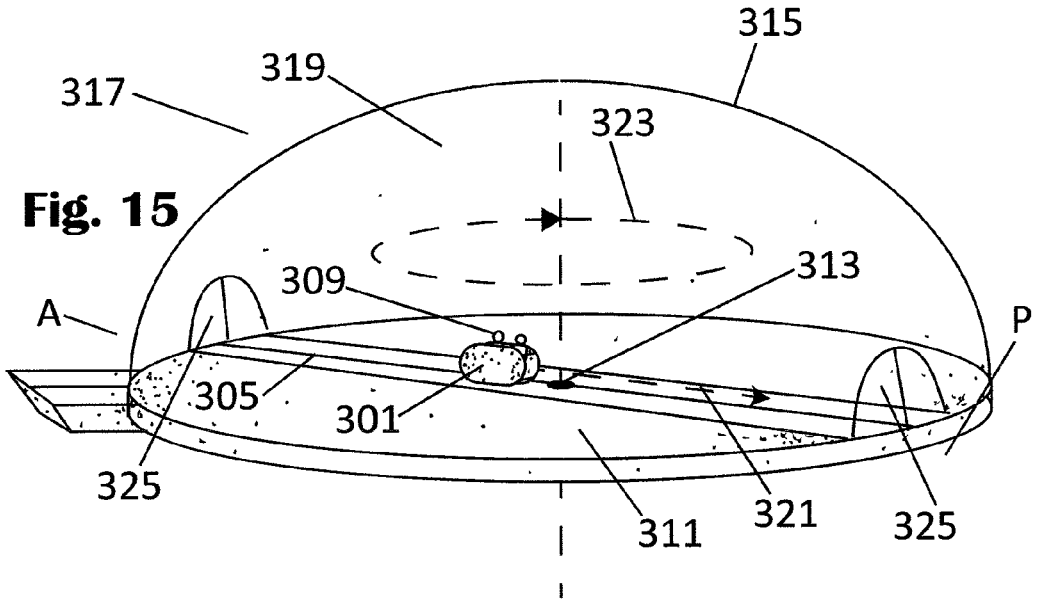
FIG. 15 is a side view of part of a motion ride for a third embodiment of the current invention during the third of four steps of the method of the current invention for creating an illusion of teleportation.

FIG. 15 is a side view of part of a motion ride for a third embodiment of the current invention during the third of four steps of the method of the current invention for creating an illusion of teleportation. Passenger vehicle 301 is in secondary environment 319 and is carrying multiple of passenger 309 over ride track 305 and through enclosing structure 315. Passenger vehicle 301 has vehicular velocity 321. Enclosing structure 315 has the shape of an elliptical passageway that connects to rotating platform 311 and is moving with angular structural velocity 323. Enclosing structure 315 has multiple of movable door 325 on the ends of the elliptical passageway shape. Multiple of movable door 325 can open and close at edges of rotating platform 311 where ride track 305 connects and disconnects to rotating platform 311 as a connecting and disconnecting ride track. Secondary environment 319 is the environment inside enclosing structure 315. Primary environment 317 is located external to secondary environment 319. Movable door 325 that passenger vehicle 301 previously passed through is closed to visually encapsulate passenger vehicle 301 inside enclosing structure 315. Rotating platform 311 has capability to rotate around central axis 313 and is rotating around central axis 313 with angular velocity 323. Perceived final destination P is identified as an area where riders of passenger vehicle 301 are anticipating is their final destination based upon their perceived motion through the motion ride. Actual final destination A is identified as an area where riders of passenger vehicle 301 actually arrive in contrast to their perceived motion through the motion ride.

Figure 16:
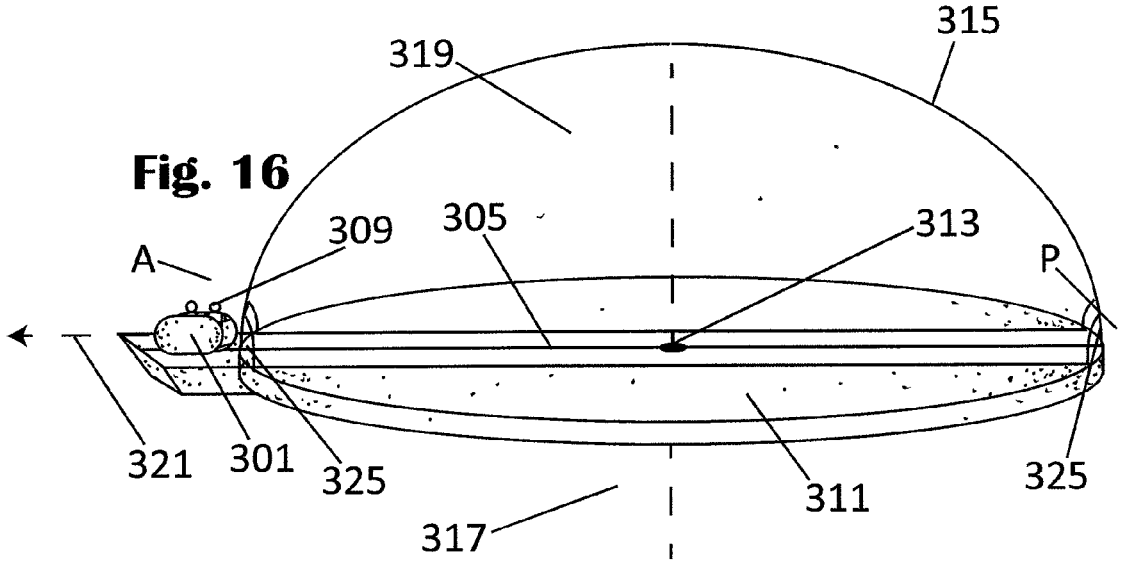
FIG. 16 is a side view of part of a motion ride for a third embodiment of the current invention during the fourth of four steps of the method of the current invention for creating an illusion of teleportation.

FIG. 16 is a side view of part of a motion ride for a third embodiment of the current invention during the fourth of four steps of the method of the current invention for creating an illusion of teleportation. Passenger vehicle 301 is leaving secondary environment 319 over ride track 305 and is carrying multiple of passenger 309 into primary environment 317.

Passenger vehicle 301 has vehicular velocity 321. Enclosing structure 315 has the shape of an elliptical passageway that connects to rotating platform 311. Enclosing structure 315 has multiple of movable door 325 on the ends of the elliptical passageway shape. Multiple of movable door 325 can open and close at edges of rotating platform 311 where ride track 305 connects and disconnects to rotating platform 311 as a connecting and disconnecting ride track. Secondary environment 319 is the environment inside enclosing structure 315. Primary environment 317 is located external to secondary environment 319. Movable door 325 that passenger vehicle 301 is passing through is open. Rotating platform 311 has capability to rotate around central axis 313. Perceived final destination P is identified as an area where riders of passenger vehicle 301 are anticipating is their final destination based upon their perceived motion through the motion ride. Actual final destination A is identified as an area where riders of passenger vehicle 301 actually arrive in contrast to their perceived motion through the motion ride.

Figure 17:
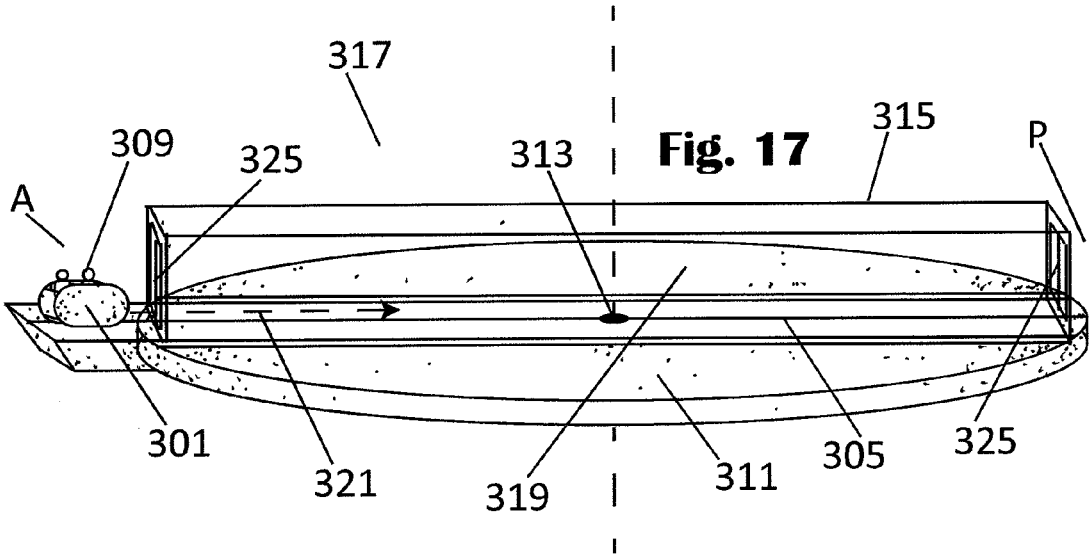
FIG. 17 is a side view of part of a motion ride for a first embodiment of the current invention during the first of four steps of the method of the current invention for creating an illusion of teleportation.

FIG. 17 is a side view of part of a motion ride for a first embodiment of the current invention during the first of four steps of the method of the current invention for creating an illusion of teleportation. Passenger vehicle 301 is in primary environment 317 carrying multiple of a passenger 309 and beginning to move over ride track 305 and into enclosing structure 315. Passenger vehicle 301 has vehicular velocity 321. Enclosing structure 315 has the shape of a tubular passageway that connects to rotating platform 311. Enclosing structure 315 has multiple of movable door 325 on the ends of the tubular passageway shape. Multiple of movable door 325 can open and close at edges of rotating platform 311 where ride track 305 connects and disconnects to rotating platform 311 as a connecting and disconnecting ride track. Secondary environment 319 is the environment inside enclosing structure 315. Primary environment 317 is located external to secondary environment 319. Rotating platform 311 has capability to rotate around central axis 313. Perceived final destination P is identified as an area where riders of passenger vehicle 301 are anticipating is their final destination based upon their perceived motion through the motion ride. Actual final destination A is identified as an area where riders of passenger vehicle 301 actually arrive in contrast to their perceived motion through the motion ride.

Figure 18:
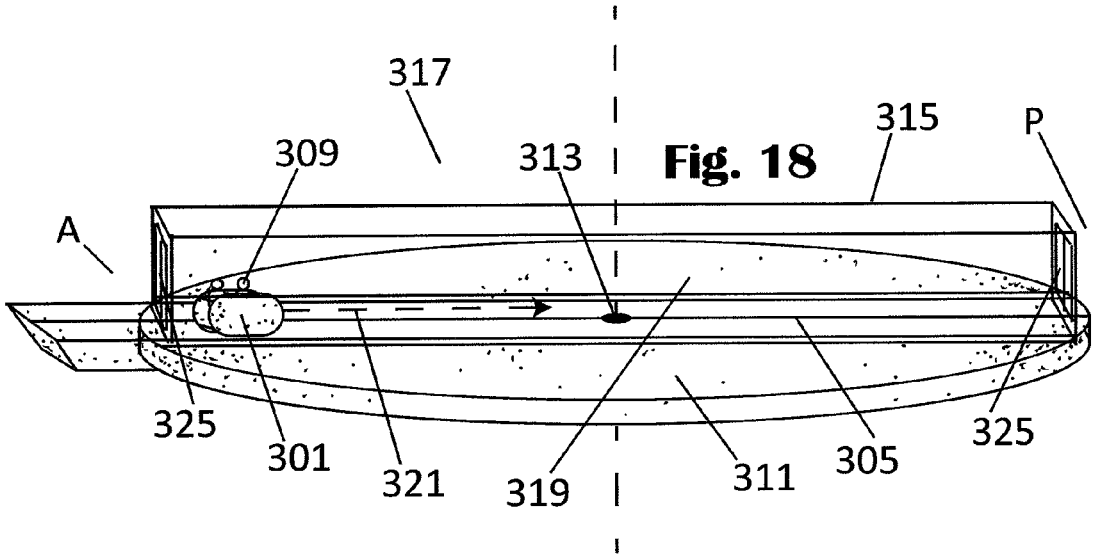
FIG. 18 is a side view of part of a motion ride for a first embodiment of the current invention during the second of four steps of the method of the current invention for creating an illusion of teleportation.

FIG. 18 is a side view of part of a motion ride for a first embodiment of the current invention during the second of four steps of the method of the current invention for creating an illusion of teleportation. Passenger vehicle 301 carrying multiple of passenger 309 has entered secondary environment 319 and is moving over ride track 305 and through enclosing structure 315. Passenger vehicle 301 has vehicular velocity 321. Enclosing structure 315 has the shape of a tubular passageway that connects to rotating platform 311. Enclosing structure 315 has multiple of movable door 325 on the ends of the tubular passageway shape. Multiple of movable door 325 can open and close at edges of rotating platform 311 where ride track 305 connects and disconnects to rotating platform 311 as a connecting and disconnecting ride track. Secondary environment 319 is the environment inside enclosing structure 315. Primary environment 317 is located external to secondary environment 319. Movable door 325 that passenger vehicle 301 has passed through has closed to visually encapsulate passenger vehicle 301 inside enclosing structure 315. Rotating platform 311 has capability to rotate around central axis 313. Perceived final destination P is identified as an area where riders of passenger vehicle 301 are anticipating is their final destination based upon their perceived motion through the motion ride. Actual final destination A is identified as an area where riders of passenger vehicle 301 actually arrive in contrast to their perceived motion through the motion ride.

Figure 19:
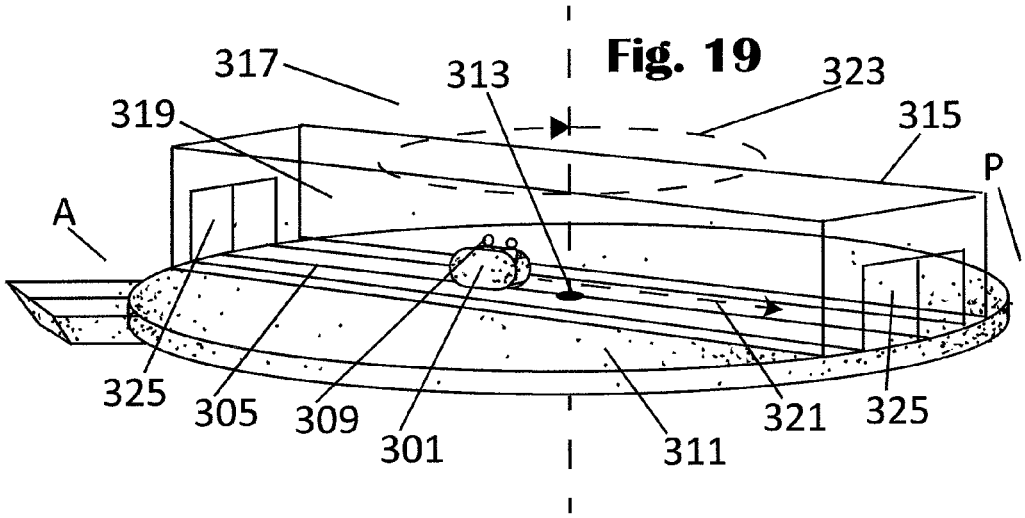
FIG. 19 is a side view of part of a motion ride for a first embodiment of the current invention during the third of four steps of the method of the current invention for creating an illusion of teleportation.

FIG. 19 is a side view of part of a motion ride for a first embodiment of the current invention during the third of four steps of the method of the current invention for creating an illusion of teleportation. Passenger vehicle 301 carrying multiple of passenger 309 is in secondary environment 319 and is moving over ride track 305 and through enclosing structure 315. Passenger vehicle 301 has vehicular velocity 321. Enclosing structure 315 has the shape of a tubular passageway that connects to rotating platform 311 and is moving with angular structural velocity 323. Enclosing structure 315 has multiple of movable door 325 on the ends of the tubular passageway shape. Multiple of movable door 325 can open and close at edges of rotating platform 311 where ride track 305 connects and disconnects to rotating platform 311 as a connecting and disconnecting ride track. Secondary environment 319 is the environment inside enclosing structure 315. Primary environment 317 is located external to secondary environment 319. Movable door 325 that passenger vehicle 301 previously passed through is closed to visually encapsulate passenger vehicle 301 inside enclosing structure 315. Rotating platform 311 has capability to rotate around central axis 313 and is rotating around central axis 313 with angular velocity 323. Perceived fmal destination P is identified as an area where riders of passenger vehicle 301 are anticipating is their fmal destination based upon their perceived motion through the motion ride. Actual fmal destination A is identified as an area where riders of passenger vehicle 301 actually arrive in contrast to their perceived motion through the motion ride.

Figure 20:
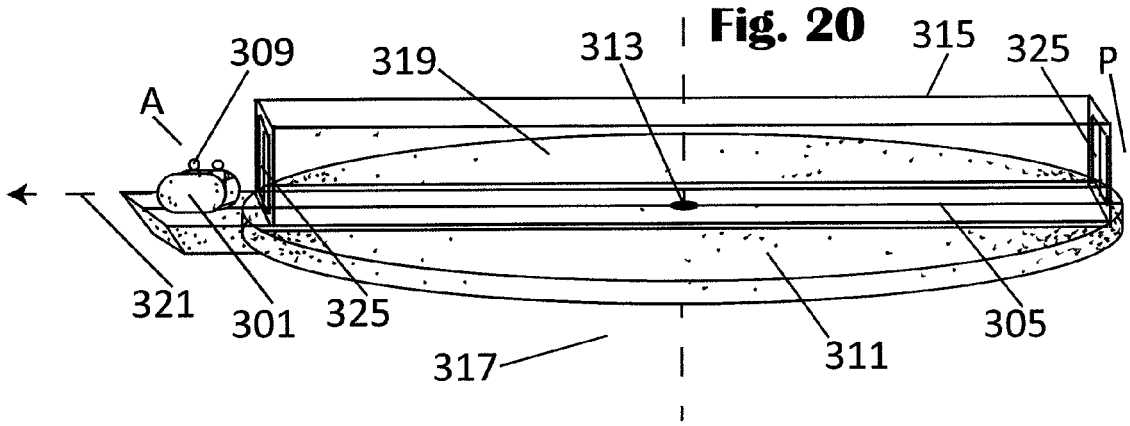
FIG. 20 is a side view of part of a motion ride for a first embodiment of the current invention during the fourth of four steps of the method of the current invention for creating an illusion of teleportation.

FIG. 20 is a side view of part of a motion ride for a first embodiment of the current invention during the fourth of four steps of the method of the current invention for creating an illusion of teleportation. Passenger vehicle 301 carrying multiple of passenger 309 is leaving secondary environment 319 and is moving over ride track 305 and into primary environment 317. Passenger vehicle 301 has vehicular velocity 321. Enclosing structure 315 has the shape of a tubular passageway that connects to rotating platform 311. Enclosing structure 315 has multiple of movable door 325 on the ends of the tubular passageway shape. Multiple of movable door 325 can open and close at edges of rotating platform 311 where ride track 305 connects and disconnects to rotating platform 311 as a connecting and disconnecting ride track. Secondary environment 319 is the environment inside enclosing structure 315. Primary environment 317 is located external to secondary environment 319. Movable door 325 that passenger vehicle 301 is passing through is open. Rotating platform 311 has capability to rotate around central axis 313. Perceived final destination P is identified as an area where riders of passenger vehicle 301 are anticipating is their final destination based upon their perceived motion through the motion ride. Actual final destination A is identified as an area where riders of passenger vehicle 301 actually arrive in contrast to their perceived motion through the motion ride.

Figure 21:
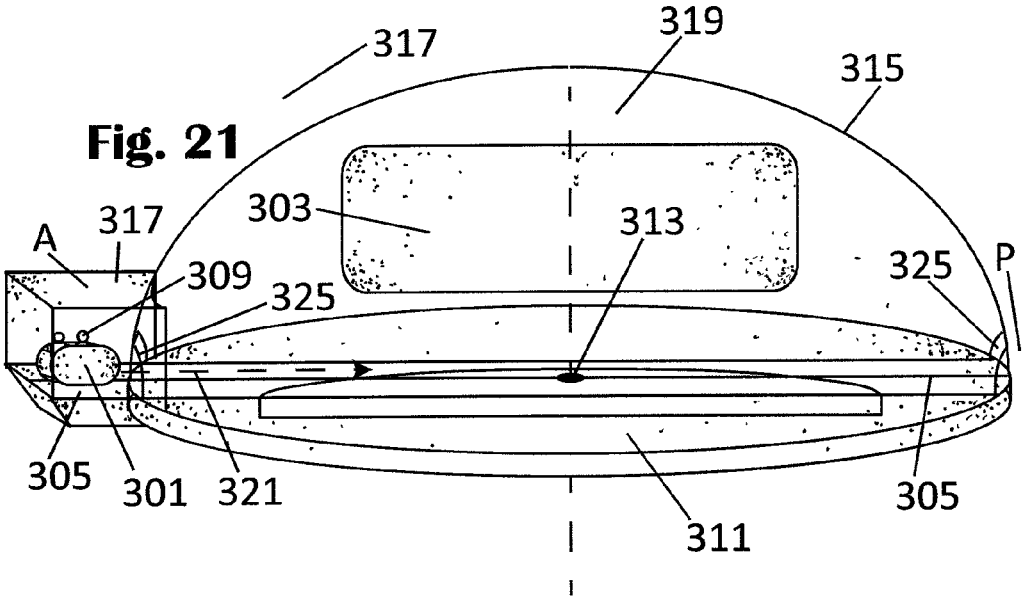
FIG. 21 is a side view of part of a motion ride for a third embodiment of the current invention during the first of four steps of the method of the current invention for creating an illusion of teleportation.

FIG. 21 is a side view of part of a motion ride for a third embodiment of the current invention during the first of four steps of the method of the current invention for creating an illusion of teleportation. Passenger vehicle 301 is in primary environment 317 carrying multiple of passenger 309 over ride track 305 and beginning to move into enclosing structure 315. Passenger vehicle 301 has vehicular velocity 321. Enclosing structure 315 has the shape of an elliptical passageway that connects to rotating platform 311. Enclosing structure 315 has multiple of movable door 325 on the ends of the elliptical passageway shape. Multiple of movable door 325 can open and close at edges of rotating platform 311 where ride track 305 connects and disconnects to rotating platform 311 as a connecting and disconnecting ride track. Secondary environment 319 is the environment inside enclosing structure 315. Primary environment 317 is located external to secondary environment 319. Rotating platform 311 has capability to rotate around central axis 313. The motion ride has a ride theme of traveling through space on a futuristic spaceship. Multiple of passenger 309 is located inside of part of primary environment 317 of a spaceship corridor and preparing to enter secondary environment 319 of a spaceship bridge room. A viewing screen 303 presents a ride movie corresponding to the futuristic spaceship theme. Perceived final destination P is identified as an area where riders of passenger vehicle 301 are anticipating is their final destination based upon their perceived motion through the motion ride. Actual final destination A is identified as an area where riders of passenger vehicle 301 actually arrive in contrast to their perceived motion through the motion ride.

Figure 22:
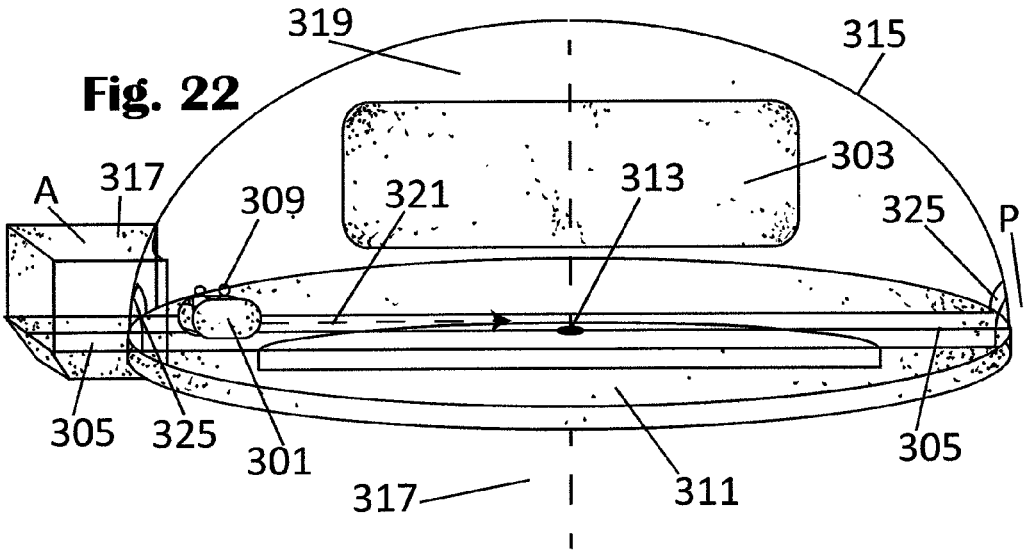
FIG. 22 is a side view of part of a motion ride for a third embodiment of the current invention during the second of four steps of the method of the current invention for creating an illusion of teleportation.

FIG. 22 is a side view of part of a motion ride for a third embodiment of the current invention during the second of four steps of the method of the current invention for creating an illusion of teleportation. Passenger vehicle 301 carrying multiple of passenger 309 has entered secondary environment 319 and is moving over ride track 305 and through enclosing structure 315. Passenger vehicle 301 has vehicular velocity 321. Enclosing structure 315 has the shape of an elliptical passageway that connects to rotating platform 311. Enclosing structure 315 has multiple of movable door 325 on the ends of the elliptical passageway shape. Multiple of movable door 325 can open and close at edges of rotating platform 311 where ride track 305 connects and disconnects to rotating platform 311 as a connecting and disconnecting ride track. Secondary environment 319 is the environment inside enclosing structure 315. Primary environment 317 is located external to secondary environment 319. Movable door 325 that passenger vehicle 301 has passed through has closed to visually encapsulate passenger vehicle 301 inside enclosing structure 315. Rotating platform 311 has capability to rotate around central axis 313. The motion ride has a ride theme of traveling through space on a futuristic spaceship. Multiple of passenger 309 has left part of primary environment 317 of a spaceship corridor and has entered secondary environment 319 of a bridge room. Viewing screen 303 presents a ride movie corresponding to the futuristic spaceship theme. Perceived final destination P is identified as an area where riders of passenger vehicle 301 are anticipating is their final destination based upon their perceived motion through the motion ride. Actual final destination A is identified as an area where riders of passenger vehicle 301 actually arrive in contrast to their perceived motion through the motion ride.

Figure 23:
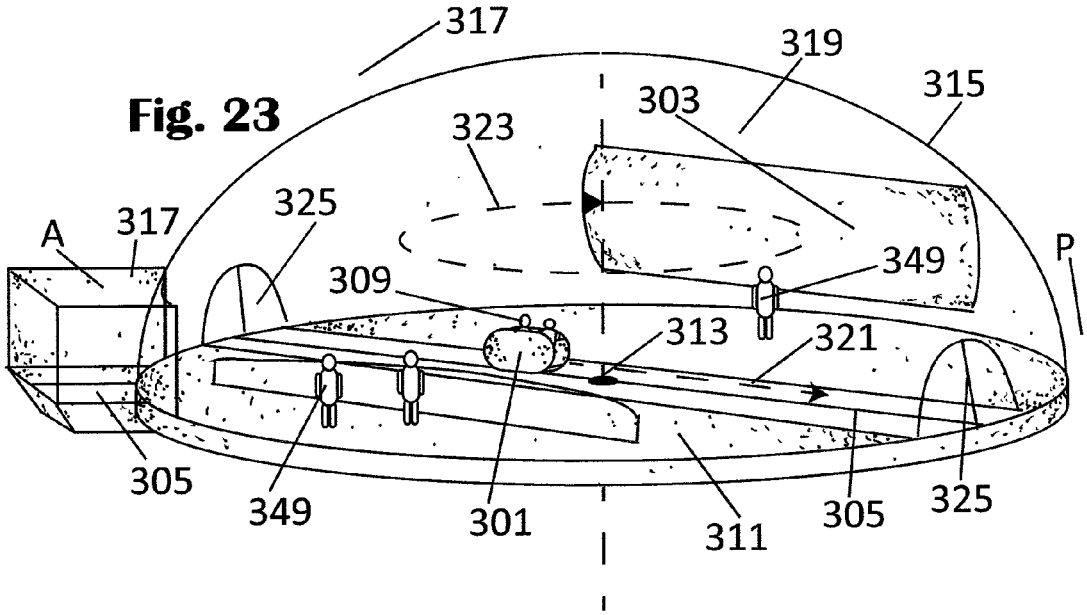
FIG. 23 is a side view of part of a motion ride for a third embodiment of the current invention during the beginning of the third of four steps of the method of the current invention for creating an illusion of teleportation.

FIG. 23 is a side view of part of a motion ride for a third embodiment of the current invention during the beginning of the third of four steps of the method of the current invention for creating an illusion of teleportation. Passenger vehicle 301 carrying multiple of passenger 309 is in secondary environment 319 and is moving over ride track 305 and through enclosing structure 315. Passenger vehicle 301 has vehicular velocity 321. Enclosing structure 315 has the shape of an elliptical passageway that connects to rotating platform 311 and is moving with angular structural velocity 323. Enclosing structure 315 has multiple of movable door 325 on the ends of the elliptical passageway shape. Multiple of movable door 325 can open and close at edges of rotating platform 311 where ride track 305 connects and disconnects to rotating platform 311 as a connecting and disconnecting ride track. Secondary environment 319 is the environment inside enclosing structure 315. Primary environment 317 is located external to secondary environment 319. Movable door 325 that passenger vehicle 301 previously passed through is closed to visually encapsulate passenger vehicle 301 inside enclosing structure 315. Rotating platform 311 has capability to rotate around central axis 313 and is rotating around central axis 313 with angular velocity 323. The motion ride has a ride theme of traveling through space on a futuristic spaceship. Multiple of passenger 309 is moving through secondary environment 319 of a bridge room. Viewing screen 303 presents a ride movie corresponding to the futuristic spaceship theme. Multiple of a ride FIG. 349 appears in secondary environment 319 of a bridge room presenting ride theme elements of danger, conflict, and suspense. Multiple of ride FIG. 349 can be multiple of an animated robotic figure, virtual image figure, other type of figure, or combination of different types of figures. Multiple of ride FIG. 349 prevents multiple of passenger 309 from returning along the path they have been traveling on during the motion ride in order to return to their original location. This conflict creates the need for the teleportation event. Perceived final destination P is identified as an area where riders of passenger vehicle 301 are anticipating is their final destination based upon their perceived motion through the motion ride. Actual final destination A is identified as an area where riders of passenger vehicle 301 actually arrive in contrast to their perceived motion through the motion ride.

Figure 24:
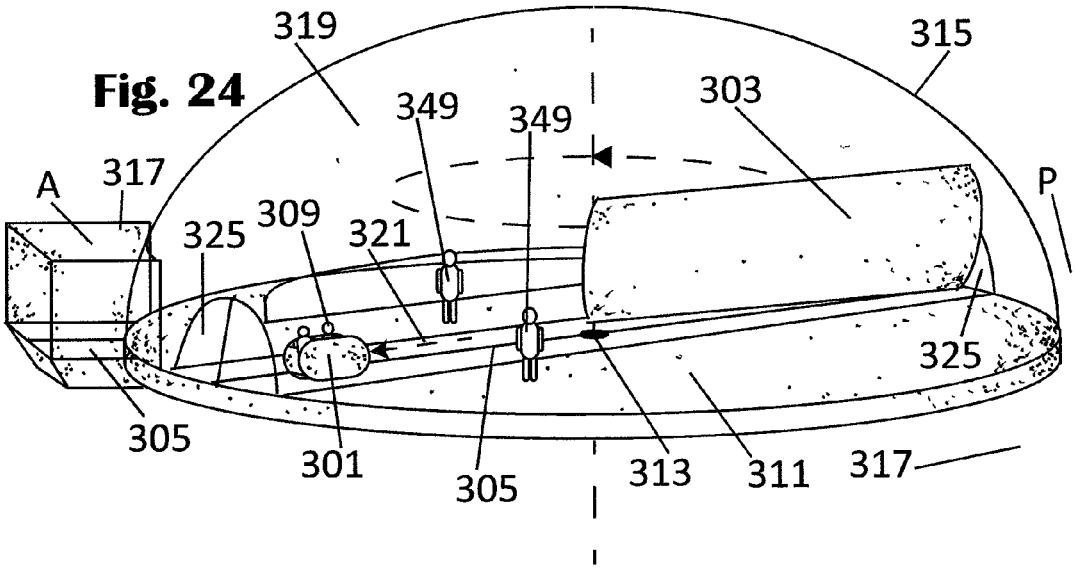
FIG. 24 is a side view of part of a motion ride for a third embodiment of the current invention during the end of the third of four steps of the method of the current invention for creating an illusion of teleportation.

FIG. 24 is a side view of part of a motion ride for a third embodiment of the current invention during the end of the third of four steps of the method of the current invention for creating an illusion of teleportation. Passenger vehicle 301 carrying multiple of passenger 309 is in secondary environment 319 and is moving over ride track 305 and through enclosing structure 315. Passenger vehicle 301 has vehicular velocity 321. Enclosing structure 315 has the shape of an elliptical passageway that connects to rotating platform 311 and is moving with angular structural velocity 323. Enclosing structure 315 has multiple of movable door 325 on the ends of the elliptical passageway shape. Multiple of movable door 325 can open and close at edges of rotating platform 311 where ride track 305 connects and disconnects to rotating platform 311 as a connecting and disconnecting ride track. Secondary environment 319 is the environment inside enclosing structure 315. Primary environment 317 is located external to secondary environment 319. Movable door 325 that passenger vehicle 301 previously passed through is closed to visually encapsulate passenger vehicle 301 inside enclosing structure 315. Rotating platform 311 has capability to rotate around central axis 313 and is rotating around central axis 313 with angular velocity 323. The motion ride has a ride theme of traveling through space on a futuristic spaceship. Multiple of passenger 309 is moving through secondary environment 319 of a bridge room. Viewing screen 303 presents a ride movie corresponding to the futuristic spaceship theme with a ride journey presenting a conflict related to the presence of multiple of ride FIG. 349 that multiple of passenger 309 must escape from. Perceived final destination P is identified as an area where riders of passenger vehicle 301 are anticipating is their final destination based upon their perceived motion through the motion ride. Actual final destination A is identified as an area where riders of passenger vehicle 301 actually arrive in contrast to their perceived motion through the motion ride.

Figure 25:
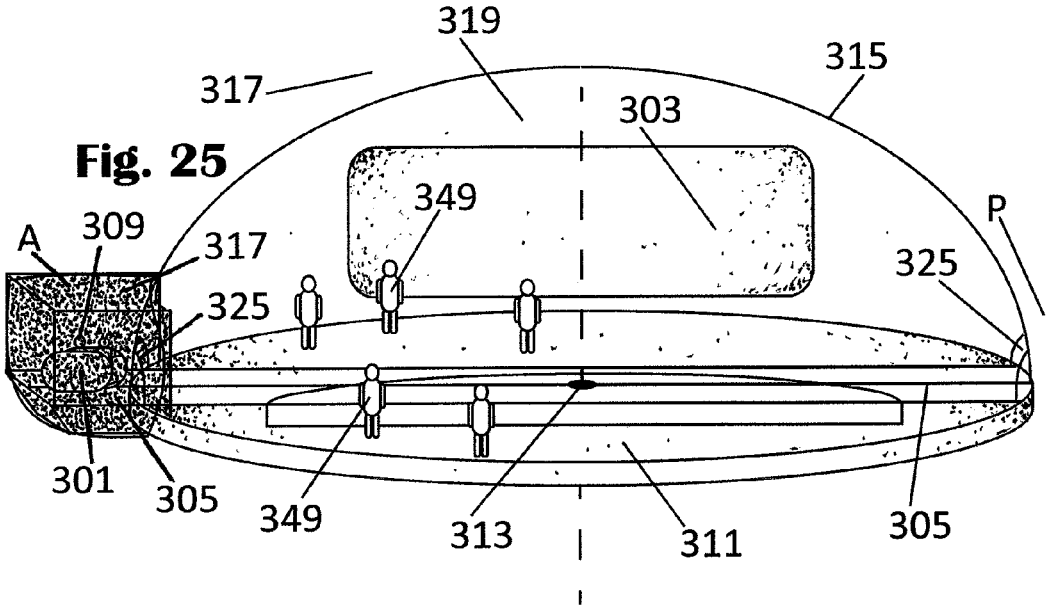
FIG. 25 is a side view of part of a motion ride for a third embodiment of the current invention during the beginning of the fourth of four steps of the method of the current invention for creating an illusion of teleportation.

FIG. 25 is a side view of part of a motion ride for a third embodiment of the current invention during the beginning of the fourth of four steps of the method of the current invention for creating an illusion of teleportation. Passenger vehicle 301 carrying multiple of passenger 309 is leaving secondary environment 319 over ride track 305 and is moving into part of primary environment 317 of a spaceship corridor. Passenger vehicle 301 has vehicular velocity 321. Enclosing structure 315 has the shape of an elliptical passageway that connects to rotating platform 311. Enclosing structure 315 has multiple of movable door 325 on the ends of the elliptical passageway shape. Multiple of movable door 325 can open and close at edges of rotating platform 311 where ride track 305 connects and disconnects to rotating platform 311 as a connecting and disconnecting ride track. Secondary environment 319 is the environment inside enclosing structure 315. Primary environment 317 is located external to secondary environment 319. Movable door 325 that passenger vehicle 301 is passing through is open. Rotating platform 311 has capability to rotate around central axis 313. Multiple of passenger 309 has moved into part of primary environment 317 of a spaceship corridor for continuing a ride journey presenting a conflict related to multiple of ride FIG. 349 that multiple of passenger 309 must escape from. With the lights dimmed in part of primary environment 317 of a spaceship corridor, multiple of passenger 309 is unaware that passenger vehicle 301 has returned to part of primary environment 317 of a spaceship corridor as multiple of passenger 309 has perceived only moving in a generally linear direction away from part of primary environment 317 of a spaceship corridor since the start of the motion ride through secondary environment 319. Perceived final destination P is identified as an area where riders of passenger vehicle 301 are anticipating is their final destination based upon their perceived motion through the motion ride. Actual final destination A is identified as an area where riders of passenger vehicle 301 actually arrive in contrast to their perceived motion through the motion ride.

Figure 26:
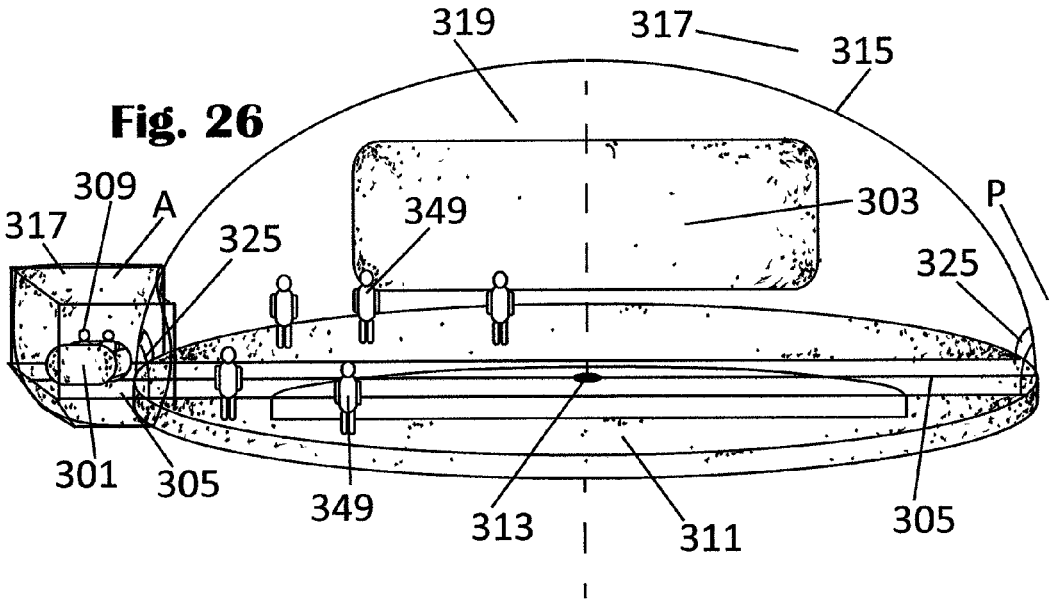
FIG. 26 is a side view of part of a motion ride for a third embodiment of the current invention during the end of the fourth of four steps of the method of the current invention for creating an illusion of teleportation.

FIG. 26 is a side view of part of a motion ride for a third embodiment of the current invention during the end of the fourth of four steps of the method of the current invention for creating an illusion of teleportation. Passenger vehicle 301 carrying multiple of passenger 309 is leaving secondary environment 319 over ride track 305 and is moving into primary environment 317. Passenger vehicle 301 has vehicular velocity 321. Enclosing structure 315 has the shape of an elliptical passageway that connects to rotating platform 311. Enclosing structure 315 has multiple of movable door 325 on the ends of the elliptical passageway shape. Multiple of movable door 325 can open and close at edges of rotating platform 311 where ride track 305 connects and disconnects to rotating platform 311 as a connecting and disconnecting ride track. Secondary environment 319 is the environment inside enclosing structure 315. Primary environment 317 is located external to secondary environment 319. Movable door 325 that passenger vehicle 301 is passing through is open. Rotating platform 311 has capability to rotate around central axis 313. Multiple of passenger 309 has moved into primary environment 317 of a spaceship corridor continuing a ride journey presenting a conflict that multiple of passenger 309 must escape from. Multiple of passenger 309 is presented with a ride theme of a teleportation event (for example, being "beamed up") to avoid going back through the bridge room of the futuristic spaceship (which is invaded by intruders as one possible conflict that arose from the theme of the ride journey). The lights are gradually brought up with other allowed possibilities of complimentary effects (for example, sound effects and motion effects) to reveal part of primary environment 317 of a spaceship corridor that multiple of passenger 309 has returned to. Perceived final destination P is identified as an area where riders of passenger vehicle 301 are anticipating is their final destination based upon their perceived motion through the motion ride. Actual final destination A is identified as an area where riders of passenger vehicle 301 actually arrive in contrast to their perceived motion through the motion ride.

Figure 27:
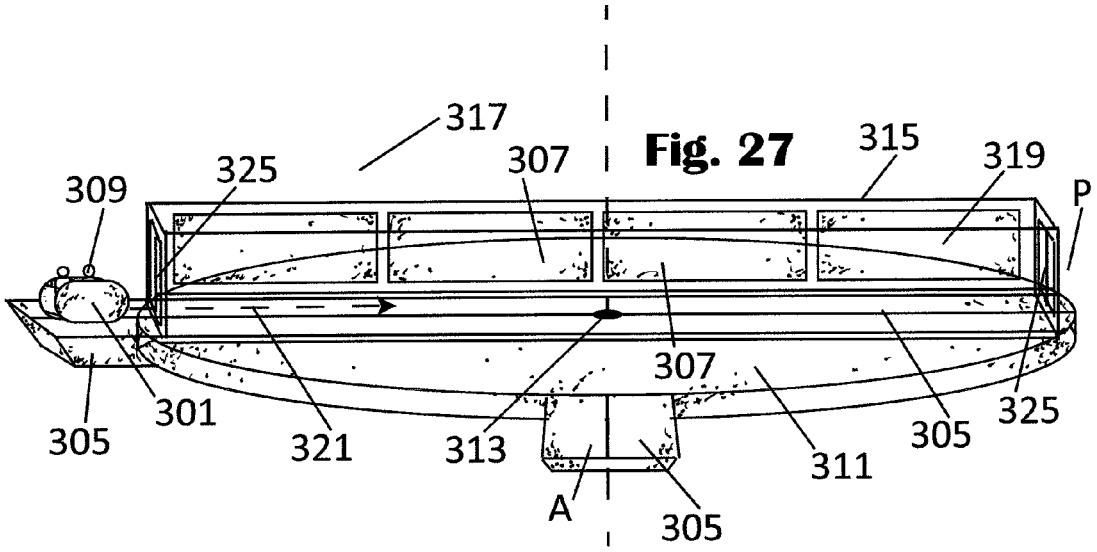
FIG. 27 is a side view of part of a motion ride for a first embodiment of the current invention during the first of four steps of the method of the current invention for creating an illusion of teleportation.

FIG. 27 is a side view of part of a motion ride for a first embodiment of the current invention during the first of four steps of the method of the current invention for creating an illusion of teleportation. Passenger vehicle 301 carrying multiple of passenger 309 is in primary environment 317 and beginning to move over ride track 305 and into enclosing structure 315. Passenger vehicle 301 has vehicular velocity 321. Enclosing structure 315 has the shape of a tubular passageway that connects to rotating platform 311. Enclosing structure 315 has multiple of movable door 325 on the ends of the tubular passageway shape. Multiple of movable door 325 can open and close at edges of rotating platform 311 where ride track 305 connects and disconnects to rotating platform 311 as a connecting and disconnecting ride track. Secondary environment 319 is the environment inside enclosing structure 315. Primary environment 317 is located external to secondary environment 319. Rotating platform 311 has capability to rotate around central axis 313. Multiple of passenger 309 is located inside part of primary environment 317 of a ride corridor and preparing to enter secondary environment 319 of a teleportation portal. Multiple of a viewing panel 307 is viewable by multiple of passenger 309 inside enclosing structure 315. Perceived final destination P is identified as an area where riders of passenger vehicle 301 are anticipating is their final destination based upon their perceived motion through the motion ride. Actual final destination A is identified as an area where riders of passenger vehicle 301 actually arrive in contrast to their perceived motion through the motion ride.

Figure 28:
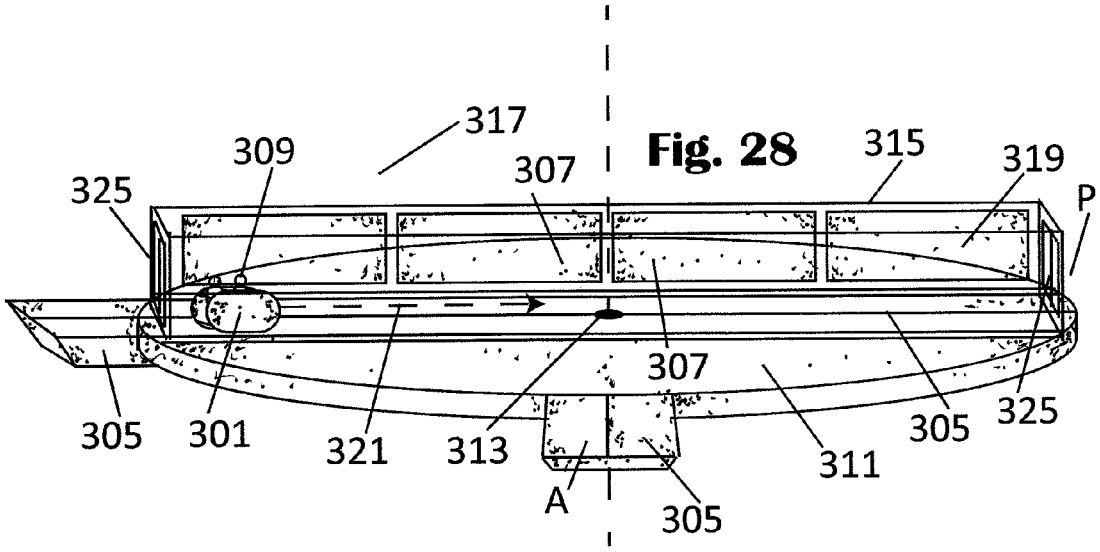
FIG. 28 is a side view of part of a motion ride for a first embodiment of the current invention during the second of four steps of the method of the current invention for creating an illusion of teleportation.

FIG. 28 is a side view of part of a motion ride for a first embodiment of the current invention during the second of four steps of the method of the current invention for creating an illusion of teleportation. Passenger vehicle 301 carrying multiple of passenger 309 has entered secondary environment 319 and is moving over ride track 305 and through enclosing structure 315. Passenger vehicle 301 has vehicular velocity 321. Enclosing structure 315 has the shape of a tubular passageway that connects to rotating platform 311. Enclosing structure 315 has multiple of movable door 325 on the ends of the tubular passageway shape. Multiple of movable door 325 can open and close at edges of rotating platform 311 where ride track 305 connects and disconnects to rotating platform 311 as a connecting and disconnecting ride track. Secondary environment 319 is the environment inside enclosing structure 315. Primary environment 317 is located external to secondary environment 319. Movable door 325 that passenger vehicle 301 has passed through has closed to visually encapsulate passenger vehicle 301 inside enclosing structure 315. Rotating platform 311 has capability to rotate around central axis 313. Multiple of passenger 309 has moved from part of primary environment 317 of a ride corridor to secondary environment 319 of a teleportation portal. Multiple of viewing panel 307 presents a ride movie corresponding to the ride theme of a teleportation event. Perceived final destination P is identified as an area where riders of passenger vehicle 301 are anticipating is their final destination based upon their perceived motion through the motion ride. Actual final destination A is identified as an area where riders of passenger vehicle 301 actually arrive in contrast to their perceived motion through the motion ride.

Figure 29:
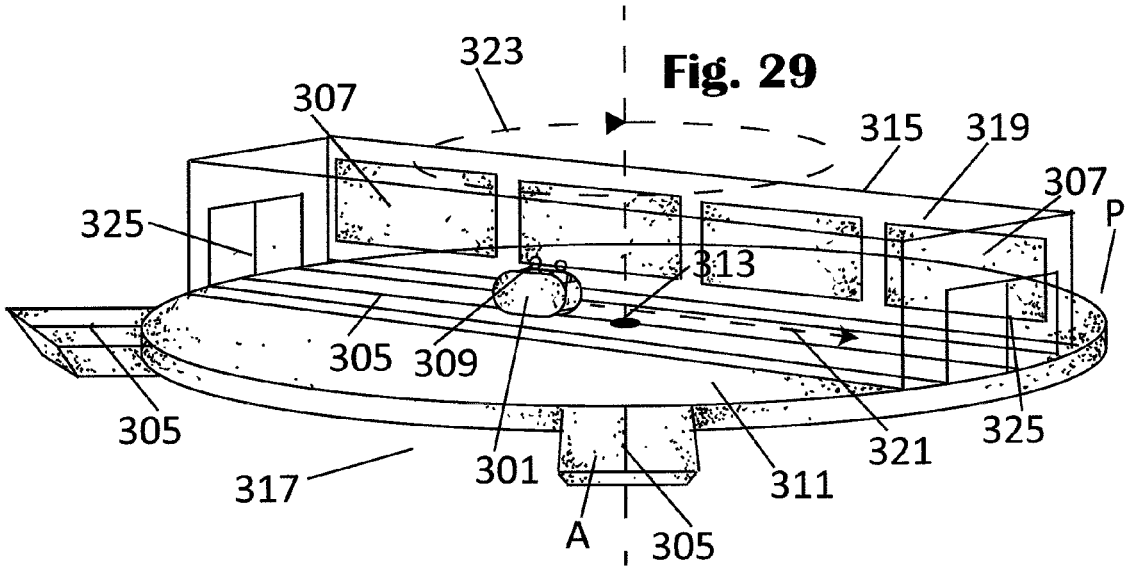
FIG. 29 is a side view of part of a motion ride for a first embodiment of the current invention during the third of four steps of the method of the current invention for creating an illusion of teleportation.

FIG. 29 is a side view of part of a motion ride for a first embodiment of the current invention during the third of four steps of the method of the current invention for creating an illusion of teleportation. Passenger vehicle 301 carrying multiple of passenger 309 is in secondary environment 319 and is moving over ride track 305 and through enclosing structure 315. Passenger vehicle 301 has vehicular velocity 321. Enclosing structure 315 has the shape of a tubular passageway that connects to rotating platform 311 and is moving with angular structural velocity 323. Enclosing structure 315 has multiple of movable door 325 on the ends of the tubular passageway shape. Multiple of movable door 325 can open and close at edges of rotating platform 311 where ride track 305 connects and disconnects to rotating platform 311 as a connecting and disconnecting ride track. Secondary environment 319 is the environment inside enclosing structure 315. Primary environment 317 is located external to secondary environment 319. Movable door 325 that passenger vehicle 301 previously passed through is closed to visually encapsulate passenger vehicle 301 inside enclosing structure 315. Rotating platform 311 has capability to rotate around central axis 313 and is rotating around central axis 313 with angular velocity 323. Multiple of passenger 309 is inside secondary environment 319 of a teleportation portal. Multiple of viewing panel 307 presents a ride movie corresponding to the continuing ride theme of a teleportation event. For example, multiple of viewing panel 307 can present video and audio for simulating a fantasy event of moving passengers instantaneously from one location to another location in space-time by a wizard's spell (for example, wizard spells for teleportation used in films like "Bedknobs and Broomsticks" and "Harry Potter and the Goblet of Fire" where the devices creating teleportation events are the "bedknob" and "goblet", respectively). These are important examples because even though both fictional sources utilize a series of wizard spells including transforming humans into animals and animating inanimate objects with life qualities for purposes such as fighting in a war, it is the teleportation spells that are the most exciting spells and are critical for presenting some of the most important developments in these stories (as apparent from their film titles). Perceived final destination P is identified as an area where riders of passenger vehicle 301 are anticipating is their final destination based upon their perceived motion through the motion ride. Actual final destination A is identified as an area where riders of passenger vehicle 301 actually arrive in contrast to their perceived motion through the motion ride.

Figure 30:
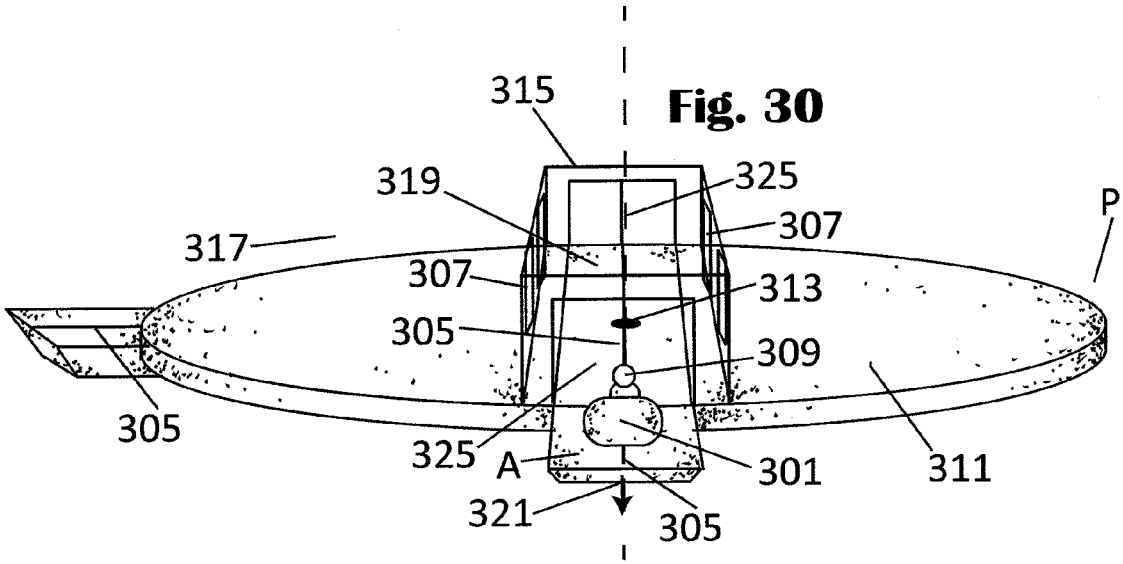
FIG. 30 is a side view of part of a motion ride for a first embodiment of the current invention during the fourth of four steps of the method of the current invention for creating an illusion of teleportation.

FIG. 30 is a side view of part of a motion ride for a first embodiment of the current invention during the fourth of four steps of the method of the current invention for creating an illusion of teleportation. Passenger vehicle 301 carrying multiple of passenger 309 is leaving secondary environment 319 and is moving over ride track 305 and into primary environment 317. Passenger vehicle 301 has vehicular velocity 321. Enclosing structure 315 has the shape of a tubular passageway that connects to rotating platform 311. Enclosing structure 315 has multiple of movable door 325 on the ends of the tubular passageway shape. Multiple of movable door 325 can open and close at edges of rotating platform 311 where ride track 305 connects and disconnects to rotating platform 311 as a connecting and disconnecting ride track. Secondary environment 319 is the environment inside enclosing structure 315. Primary environment 317 is located external to secondary environment 319. Movable door 325 that passenger vehicle 301 is passing through is open. Rotating platform 311 has capability to rotate around central axis 313. Multiple of passenger 309 has moved from secondary environment 319 of a teleportation portal to primary environment 317 of a ride corridor. Multiple of viewing panel 307 is housed within enclosing structure 315. Multiple of passenger 309 has viewed relative motion as being generally liner throughout all four steps of the method of the current invention yet arrives back to primary environment 317 moving in a direction that is ninety degrees angularly displaced from the original direction of motion of passenger vehicle 301 prior to entering into enclosing structure 315. The method would obviously compliment any shift in degrees from this original direction of motion of passenger vehicle 301 (for example, 120 degrees, 47 degrees, 180 degrees, and others). The difference in perceived direction and actual direction of motion of passenger vehicle 301 further aids other effects for creating an illusion of teleportation in the current invention by separation of perceived final destination P and actual final destination A of passenger vehicle 301. Perceived final destination P is identified as an area where riders of passenger vehicle 301 are anticipating is their final destination based upon their perceived motion through the motion ride. Actual final destination A is identified as an area where riders of passenger vehicle 301 actually arrive in contrast to their perceived motion through the motion ride.

An act of using the current invention can be accomplished once to create an illusion of teleportation on passengers of a themed teleportation ride or it can be used repetitively for an accumulated effect of illusion of teleportation. In FIGS. 31, 32, 33, 34, 35, 36, 37, 38, 39, 40, 41, 42, 43, 44, and 46, multiple of an apparatus of first embodiment K of the current invention with at least one execution of the method of the current invention for each multiple of apparatus of first embodiment K are used in succession. It should be observed that steps of the method of the current invention for each apparatus of first embodiment K are overlapped as environments are defined relative to each respective apparatus with execution of the method of the current invention. For the motion ride described in FIGS. 31, 32, 33, 34, 35, 36, 37, 38, 39, 40, 41, 42, 43, 44, and 46, five apparatus of first embodiment K are created with varying sizes and orientations relative to each other. In this motion ride, passenger vehicle 301 can enter the first of apparatus of first embodiment K by moving from primary environment 317 into secondary environment 319 of first of apparatus of first embodiment K. Upon completing the method of the current invention for this first of apparatus of first embodiment K, passenger vehicle 301 can be leaving this first of apparatus of first embodiment K and entering the second of apparatus of first embodiment K. The relative environments between this first of apparatus of first embodiment K and second of apparatus of first embodiment K are different. Primary environment 317 for this first of apparatus of first embodiment K in step four of the method of the current invention for this first of apparatus of first embodiment of K is secondary environment 319 for this second of apparatus of first embodiment K in step one of the method of the current invention for this second of apparatus of first embodiment K. It should be noted that any structure identified as apparatus of first embodiment K corresponds to having elements as described for the first embodiment of the current invention in FIGS. 1, 2, 3, and 4. Therefore, only essential elements to understanding how these multiple apparatus of first embodiment K function together to create a cumulative illusion of teleportation will be analyzed in the following of FIGS. 31, 32, 33, 34, 35, 36, 37, 38, 39, 40, 41, 42, 43, 44, and 46.

In FIGS. 31, 32, 33, 34, 35, 36, 37, 38, 39, 40, 41, 42, 43, 44, and 46, it can be seen that execution of the method of the current invention occurs six times for five apparatus of first embodiment K. This occurs because first of apparatus of first embodiment K serves as both the first execution of the method of the current invention and the sixth execution of the method of the current invention for this motion ride. Therefore, primary environment 317 is the same for the first step of the method of the first execution of the method of the current invention and the fourth step of the method of the sixth execution of the method of the current invention, resulting in a cumulative illusion of teleportation. The result of these multiple executions of the method of the current invention is a ride experience in which motion through all apparatus of first embodiment K is relatively viewed as generally linear motion through several passageways. In other words, riders on this motion ride visually experience motion in a generally linear path with passage through several doors with the surprising effect of the first and last door being the same. Such an experience is completely unintuitive. It would be the same effect as walking out of an airplane cockpit, walking down the aisle and through the several dividers only to find at the end of the plane the exact same cockpit that was initially exited from. It is apparent that the current invention creates a powerful and intense ride effect by manipulating riders into believing they are in a location that they are actually physically far from, based on their perceived motion through the motion ride, and then revealing to riders their true physical location. Size of each and total number of apparatus of first embodiment K can vary but the current arrangement, as shown in FIGS. 31, 32, 33, 34, 35, 36, 37, 38, 39, 40, 41, 42, 43, 44, and 46, is designed to compliment a ride theme of portal doors used for a ride journey of experiencing a ride event of teleporting instantly from one place in space-time to another (for example, the portals used in films like "Harry Potter", "Iron", "Monster's Inc.", and "Marvel's Avengers"). The following sections describe the details of the fourteen stages of motion that are executed for six uses of the current invention by five apparatus of first embodiment K.

Figure 31:
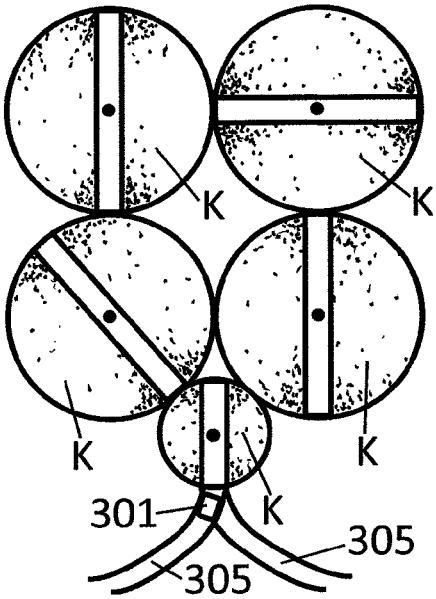
FIG. 31 is an aerial view of part of a motion ride in stage one of fourteen stages that uses five apparatus of the first embodiment of the current invention for creating six separate effects of illusion of teleportation in succession, resulting in a total effect of a cumulative illusion of teleportation.

FIG. 31 is an aerial view of part of a motion ride in stage one of fourteen stages for passenger vehicle 301 that uses five apparatus of first embodiment K of the current invention for creating six separate effects of illusion of teleportation in succession, resulting in a total effect of a cumulative illusion of teleportation. The first of apparatus of first embodiment K is smaller because it acts as a switch structure allowing multiple of passenger vehicle 301 to enter and exit through the same access point of the first of apparatus of first embodiment K. Passenger vehicle 301 is beginning to enter the first of apparatus of first embodiment K as it is in the first of four steps of the method of the current invention for the first of apparatus of first embodiment K. Segments of ride track 305 for moving into, through, and out of each five apparatus of first embodiment K can be seen.

Figure 32:
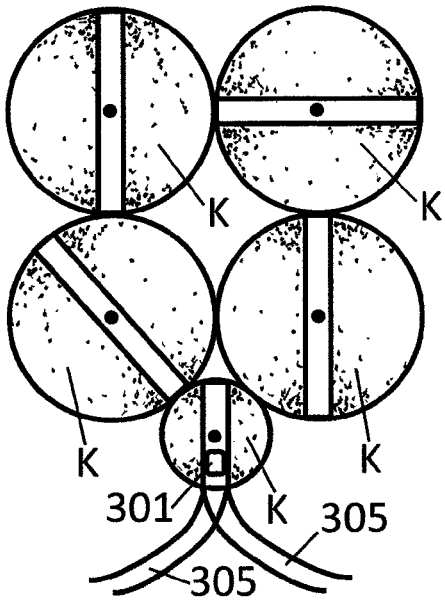
FIG. 32 is an aerial view of part of a motion ride in stage two of fourteen stages that uses five apparatus of the first embodiment of the current invention for creating six separate effects of illusion of teleportation in succession, resulting in a total effect of a cumulative illusion of teleportation.

FIG. 32 is an aerial view of part of a motion ride in stage two of fourteen stages for passenger vehicle 301 that uses five apparatus of first embodiment K of the current invention for creating six separate effects of illusion of teleportation in succession, resulting in a total effect of a cumulative illusion of teleportation. Passenger vehicle 301 has entered the first of apparatus of first embodiment K and is visually enclosed from the environment external to the first of apparatus of first embodiment K as it is in the second of four steps of the method of the current invention for the first of apparatus of first embodiment K. Segments of ride track 305 for moving into, through, and out of each five apparatus of first embodiment K can be seen.

Figure 33:
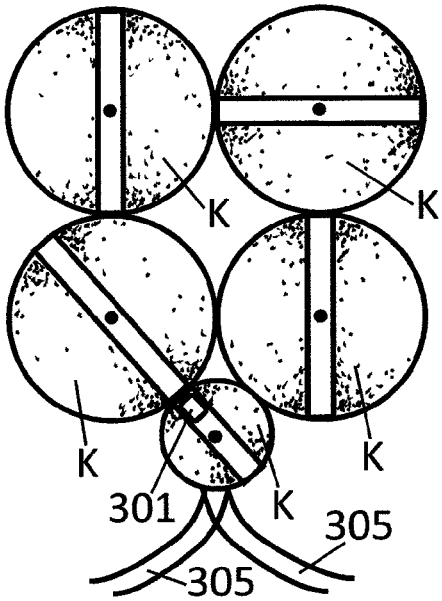
FIG. 33 is an aerial view of part of a motion ride in stage three of fourteen stages that uses five apparatus of the first embodiment of the current invention for creating six separate effects of illusion of teleportation in succession, resulting in a total effect of a cumulative illusion of teleportation.

FIG. 33 is an aerial view of part of a motion ride in stage three of fourteen stages for passenger vehicle 301 that uses five apparatus of first embodiment K of the current invention for creating six separate effects of illusion of teleportation in succession, resulting in a total effect of a cumulative illusion of teleportation. Passenger vehicle 301 is in the end of the third of four steps of the method of the current invention for the first of apparatus of first embodiment K which corresponds to the beginning of the first of four steps of the method of the current invention for the second of apparatus of first embodiment K. Segments of ride track 305 for moving into, through, and out of each five apparatus of first embodiment K can be seen.

Figure 34:
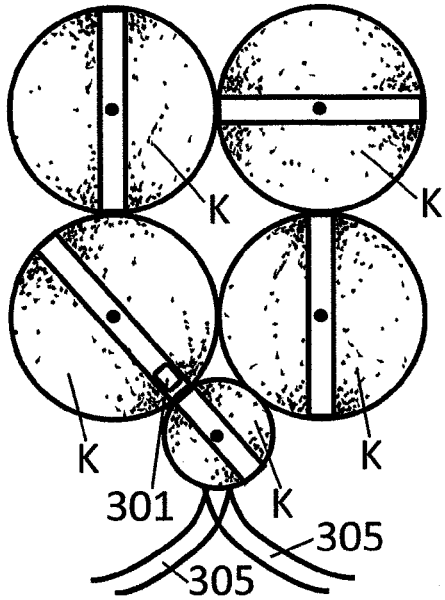
FIG. 34 is an aerial view of part of a motion ride in stage four of fourteen stages that uses five apparatus of the first embodiment of the current invention for creating six separate effects of illusion of teleportation in succession, resulting in a total effect of a cumulative illusion of teleportation.

FIG. 34 is an aerial view of part of a motion ride in stage four of fourteen stages for passenger vehicle 301 that uses five apparatus of first embodiment K of the current invention for creating six separate effects of illusion of teleportation in succession, resulting in a total effect of a cumulative illusion of teleportation. Passenger vehicle 301 is in the fourth of four steps of the method of the current invention for the first of apparatus of first embodiment K which corresponds to the second of four steps of the method of the current invention for the second of apparatus of first embodiment K. Segments of ride track 305 for moving into, through, and out of each five apparatus of first embodiment K can be seen.

Figure 35:
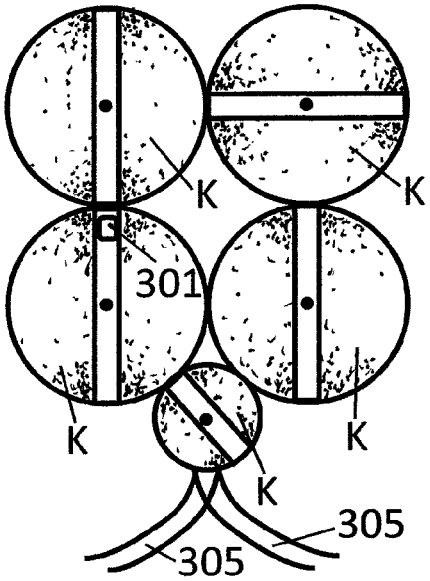
FIG. 35 is an aerial view of part of a motion ride in stage five of fourteen stages that uses five apparatus of the first embodiment of the current invention for creating six separate effects of illusion of teleportation in succession, resulting in a total effect of a cumulative illusion of teleportation.

FIG. 35 is an aerial view of part of a motion ride in stage five of fourteen stages for passenger vehicle 301 that uses five apparatus of first embodiment K of the current invention for creating six separate effects of illusion of teleportation in succession, resulting in a total effect of a cumulative illusion of teleportation. Passenger vehicle 301 is in the end of the third of four steps of the method of the current invention for the second of apparatus of first embodiment K which corresponds to the beginning of the first of four steps of the method of the current invention for the third of apparatus of first embodiment K. Segments of ride track 305 for moving into, through, and out of each five apparatus of first embodiment K can be seen.

Figure 36:
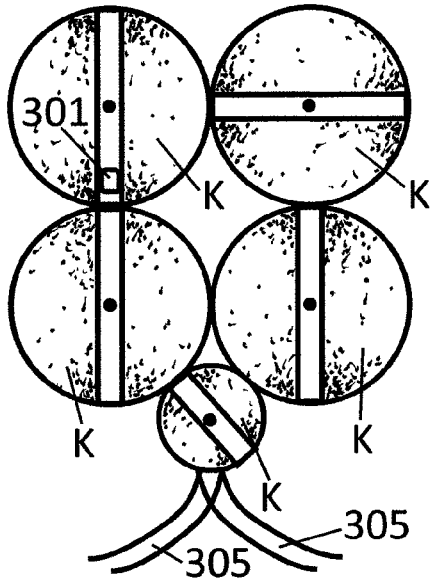
FIG. 36 is an aerial view of part of a motion ride in stage six of fourteen stages that uses five apparatus of the first embodiment of the current invention for creating six separate effects of illusion of teleportation in succession, resulting in a total effect of a cumulative illusion of teleportation.

FIG. 36 is an aerial view of part of a motion ride in stage six of fourteen stages for passenger vehicle 301 that uses five apparatus of first embodiment K of the current invention for creating six separate effects of illusion of teleportation in succession, resulting in a total effect of a cumulative illusion of teleportation. Passenger vehicle 301 is in the fourth of four steps of the method of the current invention for the second of apparatus of first embodiment K which corresponds to the second of four steps of the method of the current invention for the third of apparatus of first embodiment K. Segments of ride track 305 for moving into, through, and out of each five apparatus of first embodiment K can be seen.

Figure 37:
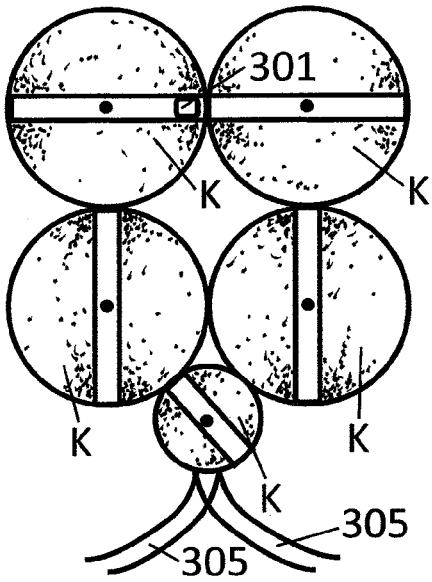
FIG. 37 is an aerial view of part of a motion ride in stage seven of fourteen stages that uses five apparatus of the first embodiment of the current invention for creating six separate effects of illusion of teleportation in succession, resulting in a total effect of a cumulative illusion of teleportation.

FIG. 37 is an aerial view of part of a motion ride in stage seven of fourteen stages for passenger vehicle 301 that uses five apparatus of first embodiment K of the current invention for creating six separate effects of illusion of teleportation in succession, resulting in a total effect of a cumulative illusion of teleportation. Passenger vehicle 301 is in the end of the third of four steps of the method of the current invention for the third of apparatus of first embodiment K which corresponds to the beginning of the first of four steps of the method of the current invention for the fourth of apparatus of first embodiment K. Segments of ride track 305 for moving into, through, and out of each five apparatus of first embodiment K can be seen.

Figure 38:
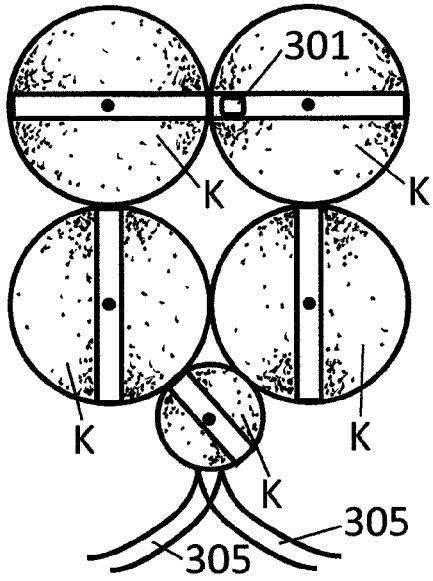
FIG. 38 is an aerial view of part of a motion ride in stage eight of fourteen stages that uses five apparatus of the first embodiment of the current invention for creating six separate effects of illusion of teleportation in succession, resulting in a total effect of a cumulative illusion of teleportation.

FIG. 38 is an aerial view of part of a motion ride in stage eight of fourteen stages for passenger vehicle 301 that uses five apparatus of first embodiment K of the current invention for creating six separate effects of illusion of teleportation in succession, resulting in a total effect of a cumulative illusion of teleportation. Passenger vehicle 301 is in the fourth of four steps of the method of the current invention for the third of apparatus of first embodiment K which corresponds to the second of four steps of the method of the current invention for the fourth of apparatus of first embodiment K. Segments of ride track 305 for moving into, through, and out of each five apparatus of first embodiment K can be seen.

Figure 39:
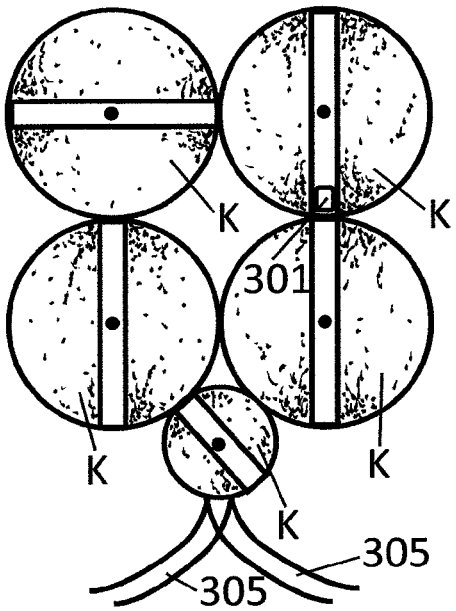
FIG. 39 is an aerial view of part of a motion ride in stage nine of fourteen stages that uses five apparatus of the first embodiment of the current invention for creating six separate effects of illusion of teleportation in succession, resulting in a total effect of a cumulative illusion of teleportation.

FIG. 39 is an aerial view of part of a motion ride in stage nine of fourteen stages for passenger vehicle 301 that uses five apparatus of first embodiment K of the current invention for creating six separate effects of illusion of teleportation in succession, resulting in a total effect of a cumulative illusion of teleportation. Passenger vehicle 301 is in the end of the third of four steps of the method of the current invention for the fourth of apparatus of first embodiment K which corresponds to the beginning of the first of four steps of the method of the current invention for the fifth of apparatus of first embodiment K. Segments of ride track 305 for moving into, through, and out of each five apparatus of first embodiment K can be seen.

Figure 40:
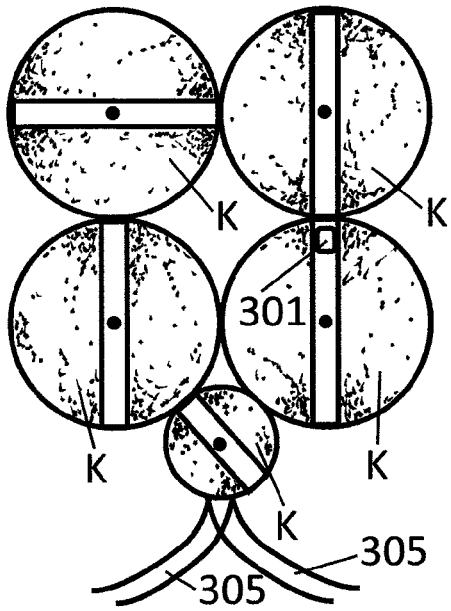
FIG. 40 is an aerial view of part of a motion ride in stage ten of fourteen stages that uses five apparatus of the first embodiment of the current invention for creating six separate effects of illusion of teleportation in succession, resulting in a total effect of a cumulative illusion of teleportation.

FIG. 40 is an aerial view of part of a motion ride in stage ten of fourteen stages for passenger vehicle 301 that uses five apparatus of first embodiment K of the current invention for creating six separate effects of illusion of teleportation in succession, resulting in a total effect of a cumulative illusion of teleportation. Passenger vehicle 301 is in the fourth of four steps of the method of the current invention for the fourth of apparatus of first embodiment K which corresponds to the second of four steps of the method of the current invention for the fifth of apparatus of first embodiment K. Segments of ride track 305 for moving into, through, and out of each five apparatus of first embodiment K can be seen.

Figure 41:
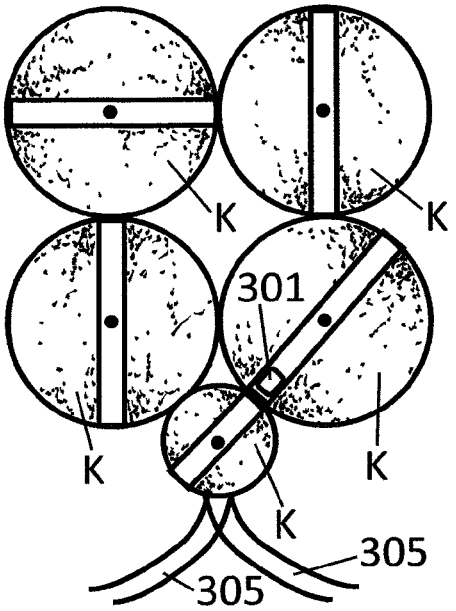
FIG. 41 is an aerial view of part of a motion ride in stage eleven of fourteen stages that uses five apparatus of the first embodiment of the current invention for creating six separate effects of illusion of teleportation in succession, resulting in a total effect of a cumulative illusion of teleportation.

FIG. 41 is an aerial view of part of a motion ride in stage eleven of fourteen stages for passenger vehicle 301 that uses five apparatus of first embodiment K of the current invention for creating six separate effects of illusion of teleportation in succession, resulting in a total effect of a cumulative illusion of teleportation. Passenger vehicle 301 is in the end of the third of four steps of the method of the current invention for the fifth of apparatus of first embodiment K which corresponds to the beginning of the first of four steps of the method of the current invention for the second use of the first of apparatus of first embodiment K. Segments of ride track 305 for moving into, through, and out of each five apparatus of first embodiment K can be seen.

Figure 42:
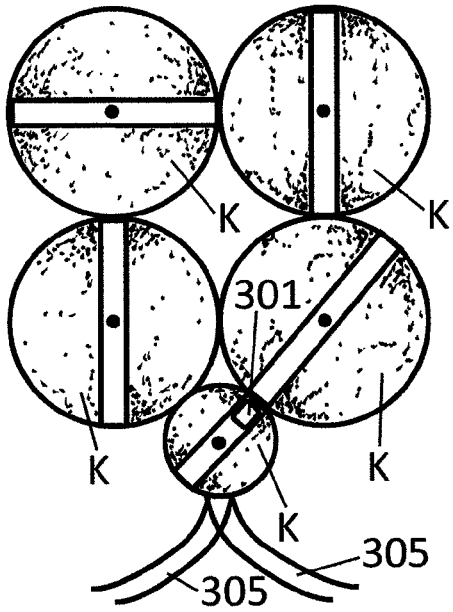
FIG. 42 is an aerial view of part of a motion ride in stage twelve of fourteen stages that uses five apparatus of the first embodiment of the current invention for creating six separate effects of illusion of teleportation in succession, resulting in a total effect of a cumulative illusion of teleportation.

FIG. 42 is an aerial view of part of a motion ride in stage twelve of fourteen stages passenger vehicle 301 that uses five apparatus of first embodiment K of the current invention for creating six separate effects of illusion of teleportation in succession, resulting in a total effect of a cumulative illusion of teleportation. Passenger vehicle 301 is in the fourth of four steps of the method of the current invention for the fifth of apparatus of first embodiment K which corresponds to the second of four steps of the method of the current invention for the second use of the first of apparatus of first embodiment K. Segments of ride track 305 for moving into, through, and out of each five apparatus of first embodiment K can be seen.

Figure 43:
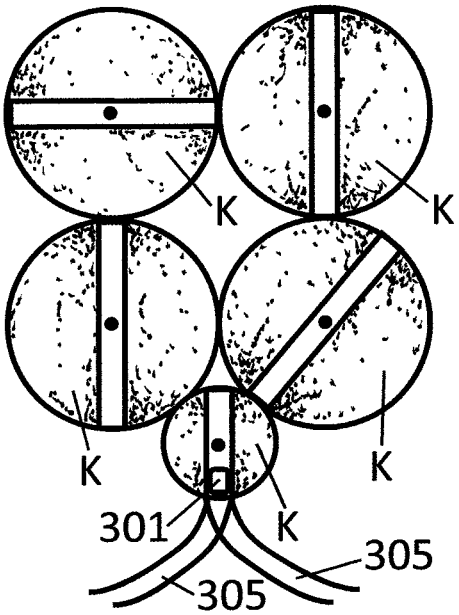
FIG. 43 is an aerial view of part of a motion ride in stage thirteen of fourteen stages that uses five apparatus of the first embodiment of the current invention for creating six separate effects of illusion of teleportation in succession, resulting in a total effect of a cumulative illusion of teleportation.

FIG. 43 is an aerial view of part of a motion ride in stage thirteen of fourteen stages for passenger vehicle 301 that uses five apparatus of first embodiment K of the current invention for creating six separate effects of illusion of teleportation in succession, resulting in a total effect of a cumulative illusion of teleportation. Passenger vehicle 301 is in the third of four steps of the method of the current invention for the second use of the first of apparatus of first embodiment K. Segments of ride track 305 for moving into, through, and out of each five apparatus of first embodiment K can be seen.

Figure 44:
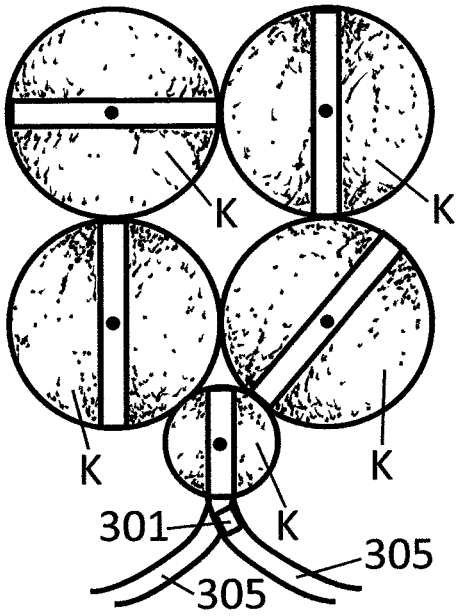
FIG. 44 is an aerial view of part of a motion ride in stage fourteen of fourteen stages that uses five apparatus of the first embodiment of the current invention for creating six separate effects of illusion of teleportation in succession, resulting in a total effect of a cumulative illusion of teleportation.

FIG. 44 is an aerial view of part of a motion ride in stage fourteen of fourteen stages for passenger vehicle 301 that uses five apparatus of first embodiment K of the current invention for creating six separate effects of illusion of teleportation in succession, resulting in a total effect of a cumulative illusion of teleportation. Passenger vehicle 301 is in the fourth of four steps of the method of the current invention for the second use of the first of apparatus of first embodiment K. Segments of ride track 305 for moving into, through, and out of each five apparatus of first embodiment K can be seen. This last stage completes the total effect of a cumulative illusion of teleportation by the six executions of the method of the current invention by five apparatus of first embodiment K. The result is an exciting journey where each of the five apparatus of the first embodiment K can be used to house an array of motion ride elements (for example, screen projections, robotic figures, and other common ride structures and devices) to compliment a complete motion ride with a highly effective cumulative illusion of a teleportation event. The intensity of this effect on riders of the motion ride is discussed in the following section.

Figure 45:
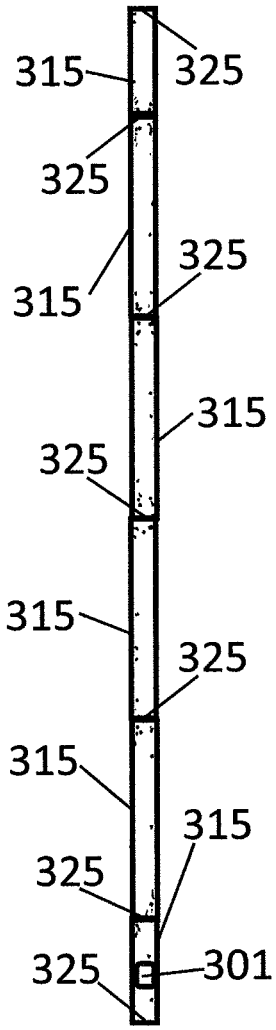
FIG. 45 is a visual representation of the relativistic and generally linear path that riders experience while moving through a motion ride that uses five apparatus of the first embodiment of the current invention for creating six separate effects of illusion of teleportation in succession, resulting in a total effect of a cumulative illusion of teleportation.

FIG. 45 is a visual representation of the generally linear path that riders experience while moving through a motion ride that uses five apparatus of first embodiment K of the current invention for creating six separate effects of illusion of teleportation in succession, as shown in FIGS. 31, 32, 33, 34, 35, 36, 37, 38, 39, 40, 41, 42, 43, and 44, resulting in a total effect of a cumulative illusion of teleportation. It is immediately apparent that the long linear distance that riders relatively experience is twice the length of the longest side of the collective arrangement of the five apparatus of first embodiment K. This further highlights the intensity of effects of the current invention for manipulating the ride experience of riders. Furthermore, the current invention not only accomplishes this novel effect of creating the illusion of teleportation but can also perform it in a space-conserving manner. It should be noted that the top and bottom portions of FIG. 45 correspond to the same physical access point of the motion ride that serves as both the first entrance and final exit of the motion ride as shown in FIGS. 31, 32, 33, 34, 35, 36, 37, 38, 39, 40, 41, 42, 43, and 44. Such an effect on riders to move in a generally linear direction and then to experience going through the same door at the end of the ride as the door they came through from the front of the ride would be shocking and would leave riders in a state of wonderment as the complex mechanisms behind this effect, as described above, would be neither easily or immediately understood.

Figure 46:
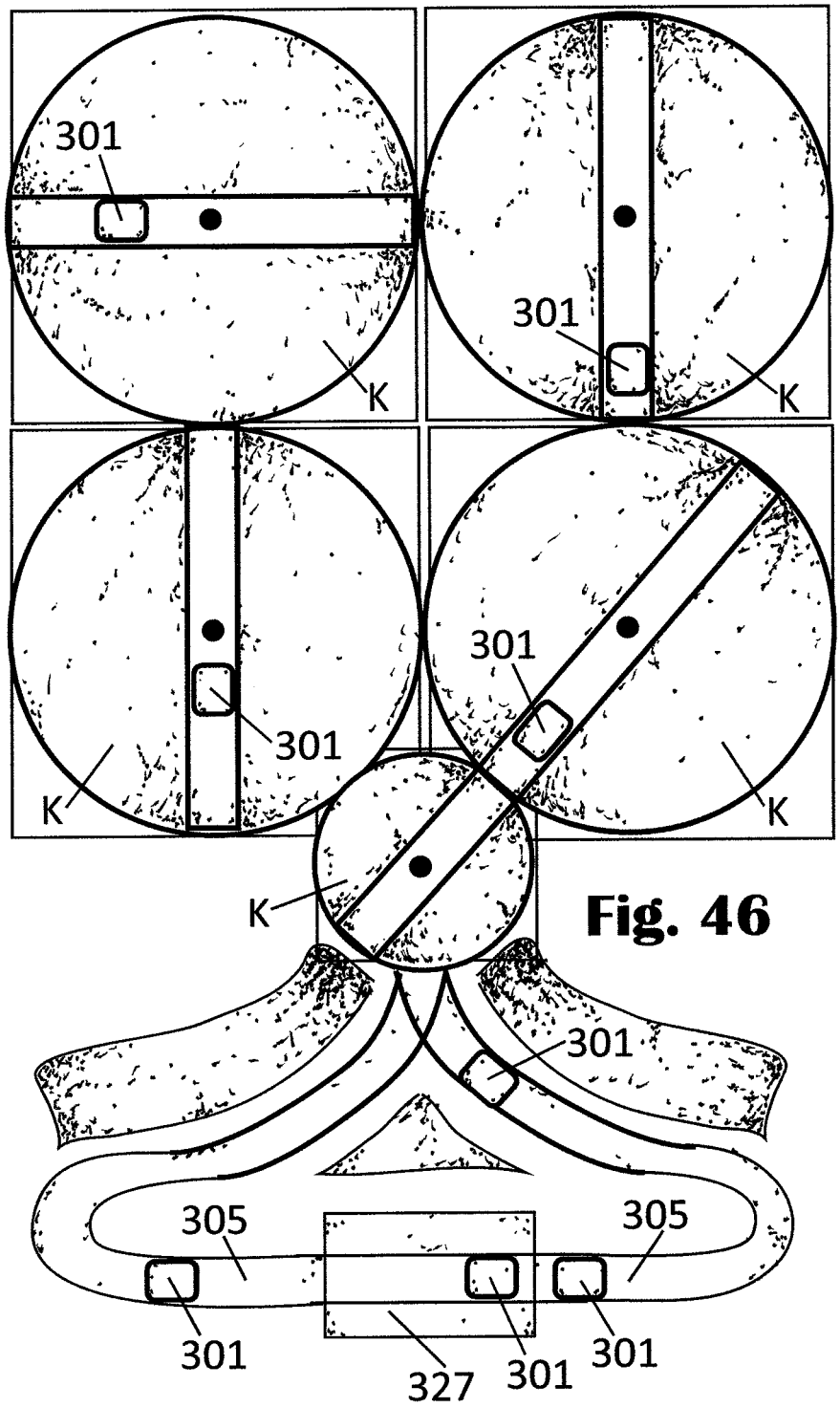
FIG. 46 is an aerial view of part of a motion ride with an unloading and loading station that uses five apparatus of the first embodiment of the current invention for creating six separate effects of illusion of teleportation in succession, resulting in a total effect of a cumulative illusion of teleportation.

FIG. 46 is an aerial view of part of a motion ride with an unloading and loading station 327 that uses five apparatus of first embodiment K of the current invention along with the method of the current invention for creating six separate effects of illusion of teleportation in succession, resulting in a total effect of a cumulative illusion of teleportation as that shown previously for each of the fourteen stages of this motion ride in FIGS. 31, 32, 33, 34, 35, 36, 37, 38, 39, 40, 41, 42, 43, and 44. Multiple of passenger vehicle 301 can be seen moving over segments of ride track 305 that extend into, through, and out of all five apparatus of first embodiment K with connecting and disconnecting ride track portions.

The first, second, and fourth of four steps of the method of the current invention are generally the same, but with minor existing differences, if comparisons are bring made across all embodiments of the current invention; however, the third of four steps of the method of the current invention is the most novel of the steps and where most of the variance between embodiments can be found. This variance is not so great as to fall outside the claims of the current invention for any of the embodiments but is enough to be able to discern between them. For example, the size, shape, and motion of the structure that encloses riders in the third of four steps of the method of the current invention can vary and still adhere to the claims of the current invention. In the first embodiment, second embodiment, and third embodiment of the current invention the size and shape of this structure that encloses riders varied among shapes of a passageway of a tubular shape, a cross shape, and an elliptical shape, respectively. The variance in the fourth, fifth, and sixth embodiments of the current invention are more related to the manner in which the structure that encloses riders is moved. For example, instead of using a platform that rotates as in the first embodiment, second embodiment, and third embodiment of the current invention, the fourth embodiment and fifth embodiment of the current invention use platforms that are horizontally shifted and vertically shifted, respectively. The sixth embodiment of the current invention uses a combination of both vertical shifting and rotation of the platform. These differences are explored in FIGS. 47, 48, and 49. It should be noted that no one embodiment is universally preferred over another and choice of one embodiment over another would vary between users. In other words, the choice of an embodiment of the current invention, or equivalent use of the current invention, would depend on the needs of the user and ride system targeted for creating an illusion of a teleportation event on riders of a motion ride for that particular ride system.

Figure 47:
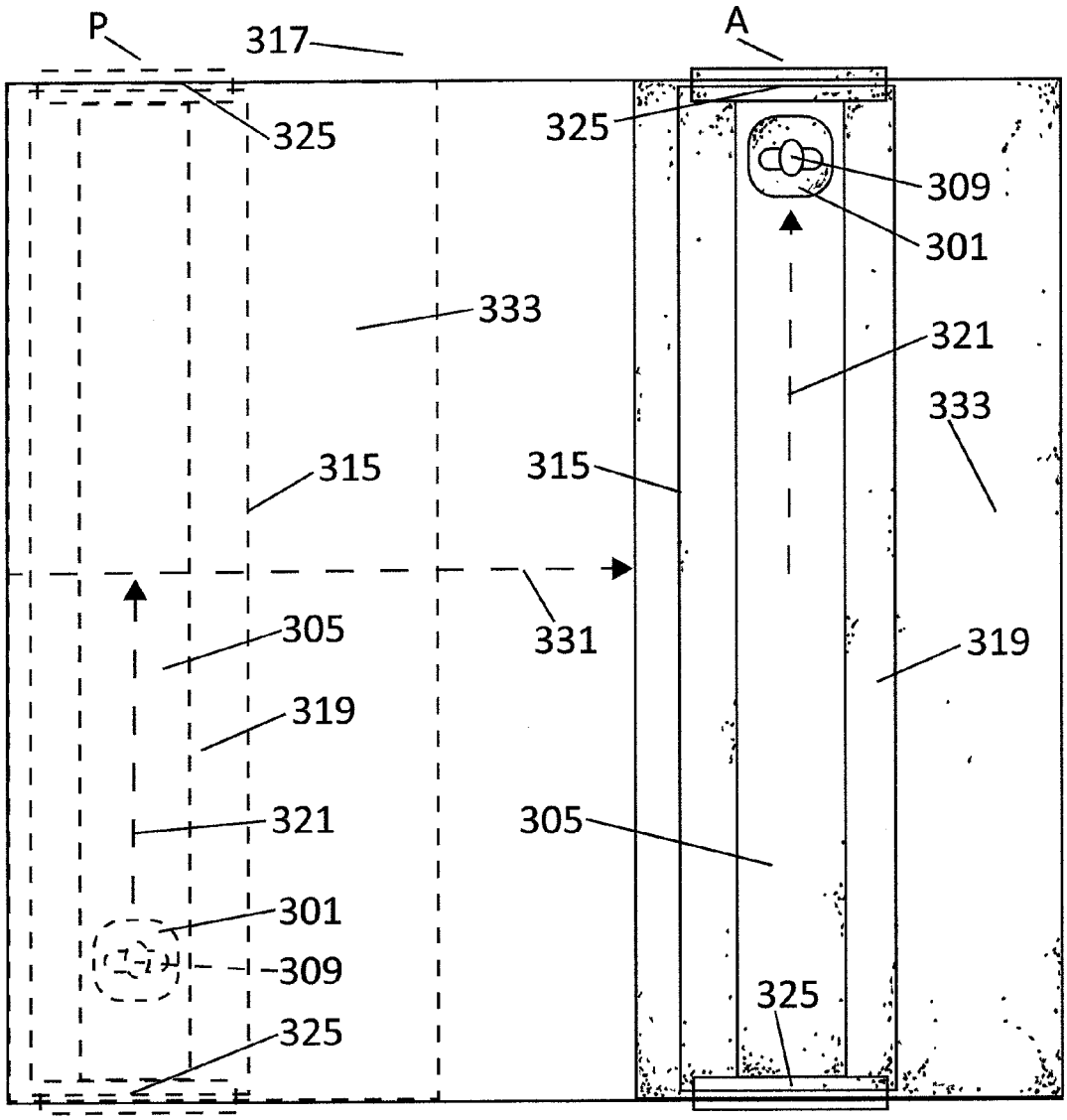
FIG. 47 is an aerial view of part of a motion ride of a fourth embodiment of the current invention during the third of four steps of the method of the current invention for creating an illusion of teleportation.

FIG. 47 is an aerial view of part of a motion ride of a fourth embodiment of the current invention during the third of four steps of the method of the current invention for creating an illusion of teleportation. As described previously, the first step, second step, and fourth step of the four steps of the method of the current invention are generally the same, but with minor existing differences, across all embodiments. The most varied step in the four steps of the method of the current invention is the third step. Like all embodiments of the current invention, the third of four steps of the method of the fourth embodiment meets the requirements of the claims of the current invention. Unlike other embodiments, however, the fourth embodiment creates horizontal displacement of a platform in the third step of the method as seen in FIG. 47 by a shifting platform 333 that is moving from left to right with a shifting platform structural velocity 329 while a passenger vehicle 301 is moving perpendicular to shifting platform 333. Passenger vehicle 301 is carrying a passenger 309 and moving with a vehicular velocity 321. A primary environment 317 is external to a secondary environment 319. Secondary environment 319 is the environment enclosed by an enclosing structure 315 (shown as transparent). Enclosing structure 315 is attached on top of shifting platform 333 and therefore moves with shifting platform 333. Passenger vehicle 301 moves along a ride track 305 that is a connecting and disconnecting ride track. Multiple of a movable door 325 (shown as transparent) can be seen on opposing sides of enclosing structure 315. Multiple of movable door 325 can allow access of passenger vehicle 301 into and out of enclosing structure 315. Each of multiple of movable door 325 is closed during the third of four steps of the current method for visually encapsulating passenger 309 inside enclosing structure 315. A perceived final destination P is identified as an area where riders of passenger vehicle 301 are anticipating is their final destination based upon their perceived motion through the motion ride. An actual final destination A is identified as an area where riders of passenger vehicle 301 actually arrive in contrast to their perceived motion through the motion ride.

Figure 48:
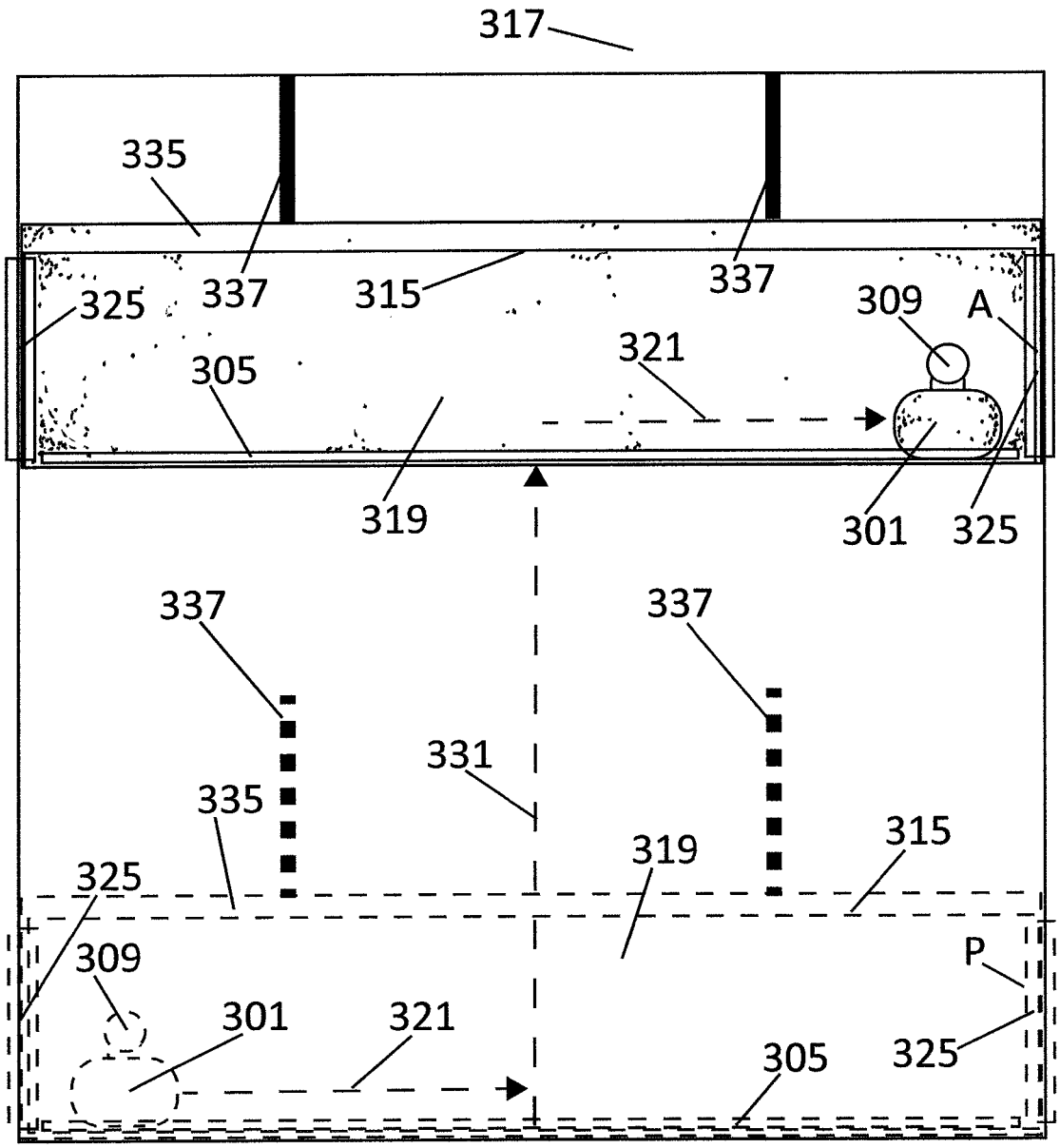
FIG. 48 is a side view of part of a motion ride of a fifth embodiment of the current invention during the third of four steps of the method of the current invention for creating an illusion of teleportation.

FIG. 48 is a side view of part of a motion ride of a fifth embodiment of the current invention during the third of four steps of the method of the current invention for creating an illusion of teleportation. As described previously, the first step, second step, and fourth step of the four steps of the method of the current invention are generally the same, but with minor existing differences, across all embodiments. The most varied step in the four steps of the method of the current invention is the third step. Like all embodiments of the current invention, the third of four steps of the method of the fifth embodiment meets the requirements of the claims of the current invention. Unlike other embodiments, however, the fifth embodiment creates vertical displacement of a platform in the third step of the method as seen in FIG. 48 by a suspended platform 335 that is moving up with a suspended platform structural velocity 331 while a passenger vehicle 301 is moving perpendicular to suspended platform 335. Passenger vehicle 301 is carrying a passenger 309 and moving with a vehicular velocity 321. A primary environment 317 is external to a secondary environment 319. Secondary environment 319 is the environment enclosed by an enclosing structure 315 (shown as transparent). Enclosing structure 315 is attached on top of suspended platform 335 and therefore moves with suspended platform 335. Passenger vehicle 301 moves along a ride track 305 that is a connecting and disconnecting ride track. Multiple of a movable door 325 (shown as transparent) can be seen on opposing sides of enclosing structure 315. Multiple of movable door 325 can allow access of passenger vehicle 301 into and out of enclosing structure 315. Each of multiple of movable door 325 is closed during the third of four steps of the current method for visually encapsulating passenger 309 inside enclosing structure 315. Multiple of a platform cable 337 are attached to suspended platform 335 and aid in lifting suspended platform 335. A perceived final destination P is identified as an area where riders of passenger vehicle 301 are anticipating is their final destination based upon their perceived motion through the motion ride. An actual final destination A is identified as an area where riders of passenger vehicle 301 actually arrive in contrast to their perceived motion through the motion ride.

Figure 49:
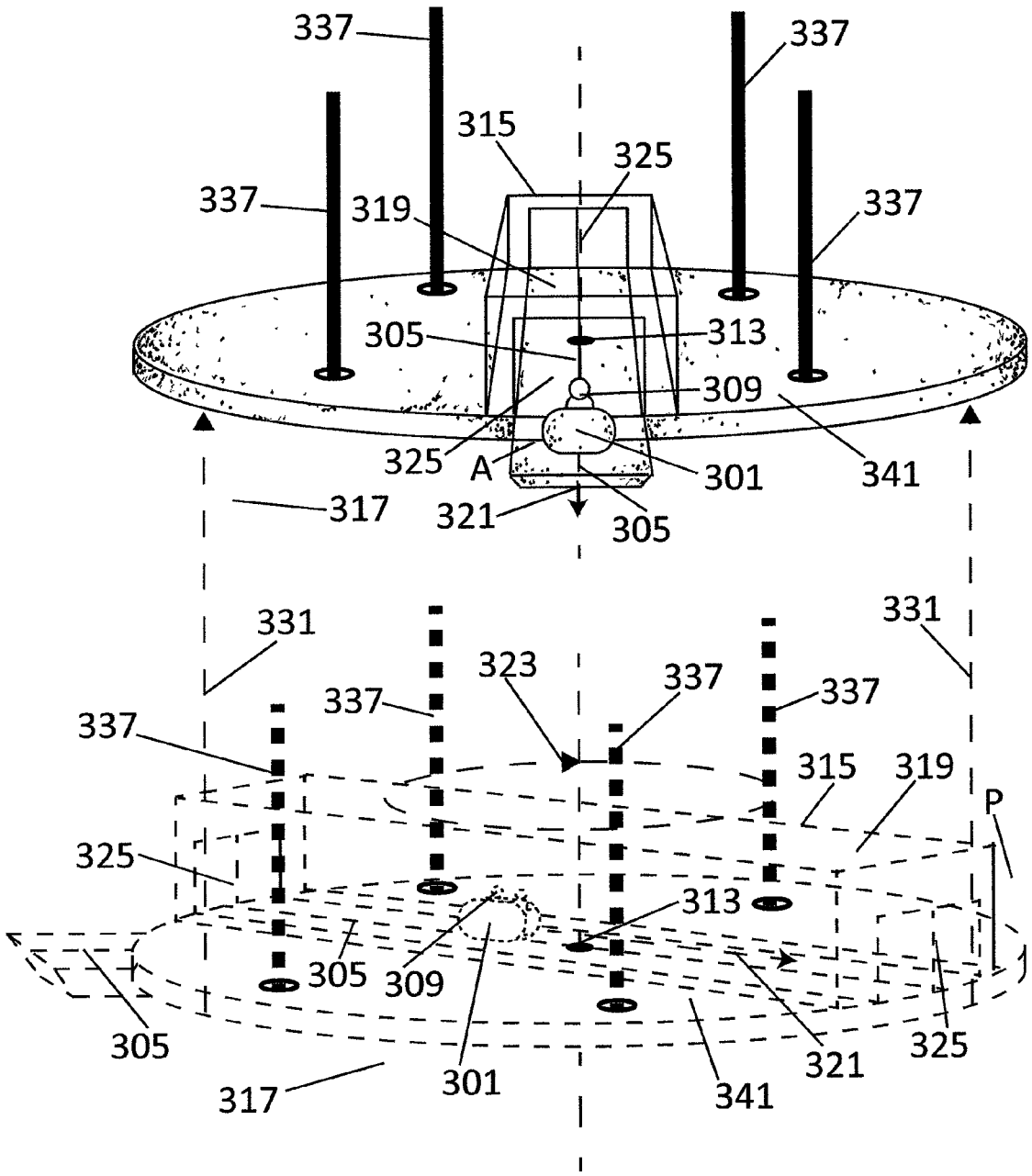
FIG. 49 is a side view of part of a motion ride of a sixth embodiment of the current invention during the third of four steps of the method of the current invention for creating an illusion of teleportation.

FIG. 49 is a side view of part of a motion ride of a sixth embodiment of the current invention during the third of four steps of the method of the current invention for creating an illusion of teleportation. As described previously, the first step, second step, and fourth step of the four steps of the method of the current invention are generally the same, but with minor existing differences, across all embodiments. The most varied step in the four steps of the method of the current invention is the third step. Like all embodiments of the current invention, the third of four steps of the method for the sixth embodiment meets the requirements of the claims of the current invention. Unlike other embodiments, however, the sixth embodiment creates horizontal and vertical displacement of a platform in the third step of the method as seen in FIG. 49 by using a rotating and suspended platform 341.

In FIG. 49, rotating and suspended platform 341 is moving up with a suspended platform structural velocity 331 and rotating with an angular structural velocity 323 while a passenger vehicle 301 is moving over and across rotating and suspended platform 341 with a vehicular velocity 321. Passenger vehicle 301 carrying a passenger 309 is in a secondary environment 319 and is moving over a ride path 305 and through an enclosing structure 315 (shown as transparent). Enclosing structure 315 has a shape of a tubular passageway that connects to rotating and suspended platform 341 and is therefore moving with the same velocities of suspended platform structural velocity 331 and angular structural velocity 323. Enclosing structure 315 has multiple of a movable door 325 (shown as transparent) on the ends of the tubular passageway shape. Multiple of movable door 325 opens and closes at edges of rotating and suspended platform 341 where ride track 305 connects and disconnects to rotating and suspended platform 341 as a connecting and disconnecting ride track. Secondary environment 319 is the environment inside enclosing structure 315. A primary environment 317 is located external to secondary environment 319. Movable door 325 that passenger vehicle 301 previously passed through is closed to visually encapsulate passenger 309 of passenger vehicle 301 inside enclosing structure 315. Rotating and suspended platform 341 has capability to rotate around a central axis 313 and is rotating around central axis 313 with angular velocity 323. Multiple of a platform cable 337 are attached to rotating and suspended platform 341 and aid in lifting rotating and suspended platform 341. A perceived final destination P is identified as an area where riders of passenger vehicle 301 are anticipating is their final destination based upon their perceived motion through the motion ride. An actual final destination A is identified as an area where riders of passenger vehicle 301 actually arrive in contrast to their perceived motion through the motion ride. The embodiments presented in the current invention highlight the broad application of the method of the current invention across a wide spectrum of apparatus and emphasizes to the reader that the current invention is only limited by its claims.

Figure 50:
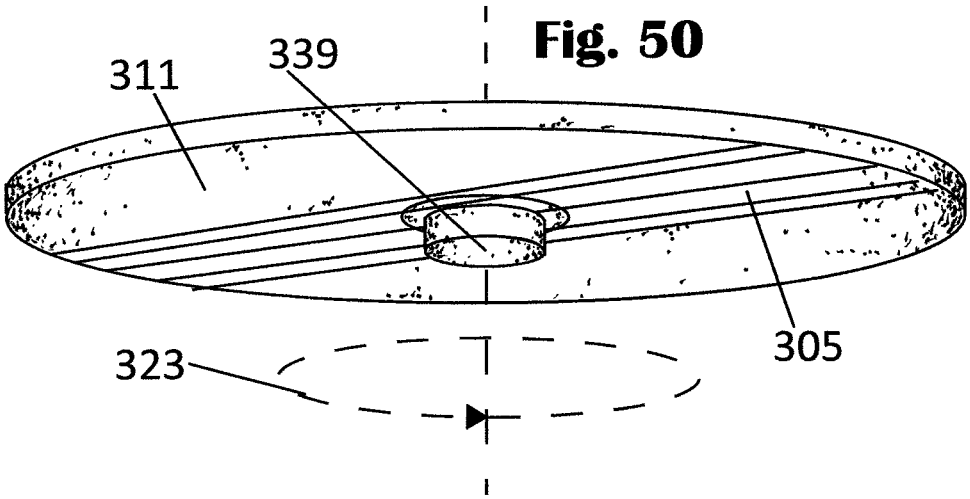
FIG. 50 shows the use of a platform motor for rotating a ride platform.

FIG. 50 shows the use of a platform rotating motor 339 for rotating a rotating platform 311. The bottom of a ride track 305 can be seen as rotating platform 311 rotates with an angular structural velocity 323 by use of platform rotating motor 339. It should be noted that angular accelerations created by platform rotating motor 339 should not be high enough to be greatly noticed, or entirely negligible to be noticed, by riders. This requires predetermined calculations of accelerations, velocities, positions, and displacements for any riders during a motion ride that is using the method of the current invention with supporting apparatus. Platform rotating motor 339 is only one type of mechanism, among many possibilities, for rotating platforms of apparatus as found in the first embodiment, second embodiment, third embodiment, and sixth embodiment of the current invention.

Figure 51:
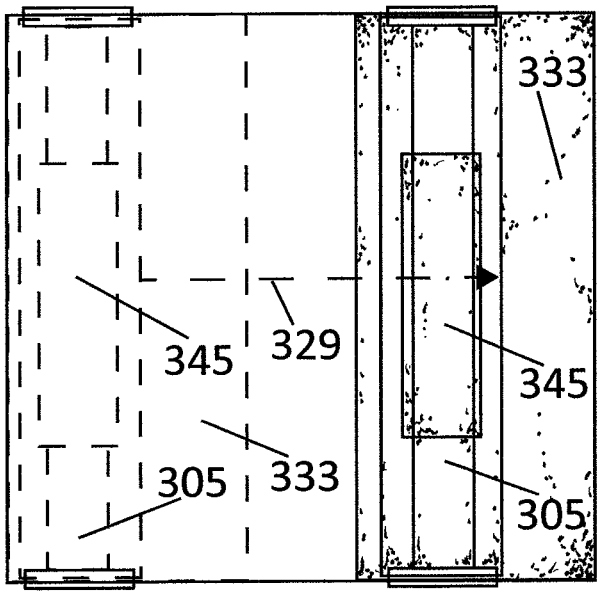
FIG. 51 shows the use of a platform motor for shifting a ride platform.

FIG. 51 shows the use of a platform shifting motor 345 for shifting a shifting platform 333. The bottom of a ride track 305 can be seen as shifting platform 333 moves in a shifting motion with a shifting platform structural velocity 329 by use of platform shifting motor 345. It should be noted that angular accelerations created by platform shifting motor 345 should not be high enough to be greatly noticed, or entirely negligible to be noticed, by riders. This requires predetermined calculations of accelerations, velocities, positions, and displacements for any riders during a motion ride that is using the method of the current invention with supporting apparatus. Platform shifting motor 345 is one type of mechanism, among many possibilities, for moving platforms of apparatus as found in the fourth embodiment of the current invention.

Figure 52:
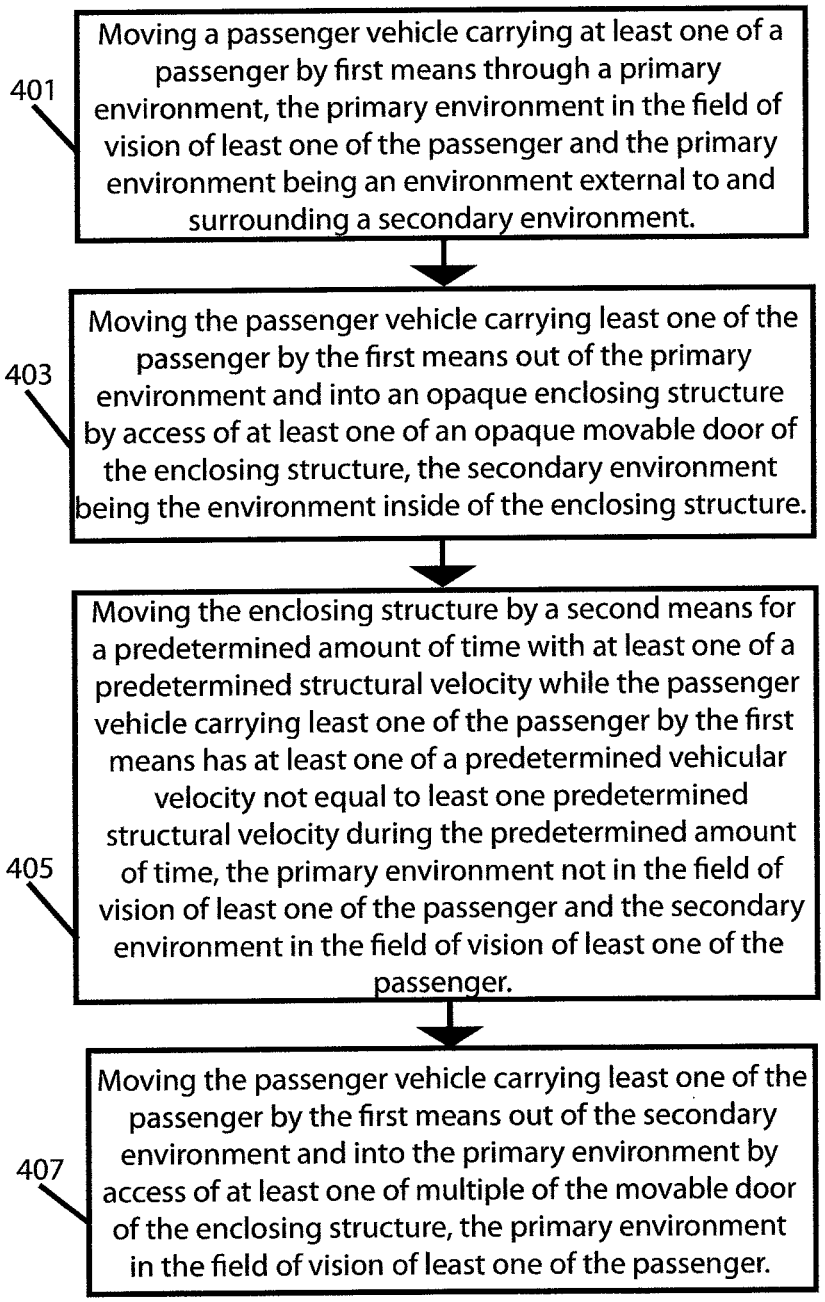
FIG. 52 is a flowchart of the four step method of the current invention for creating an illusion of teleportation, with supporting apparatus, on a multiple of passengers in a passenger vehicle moving through a motion ride.

FIG. 52 is a flowchart of the four step method of the current invention for creating an illusion of teleportation on multiple riders in a ride vehicle and moving through a motion ride. Removal of any one of the four steps would void the effect of the current invention of creating an illusion of teleportation on riders of this type of motion ride. A first step of the method of the current invention 401 , a second step of the method of the current invention 403 , a third step of the method of the current invention 405, and a fourth step of the method of the current invention 407 are shown.

Conclusion

The current invention is a four step method and apparatus for a motion ride that creates an illusion of teleportation on a multiple of passengers in a passenger vehicle of the motion ride. Multiple embodiments of diverse type and use of apparatus are presented for completing the four steps of the method. The four step method is the most unique part of the current invention. This is in comparison to the use of apparatus like the passenger vehicle and the enclosing structure which can be varied, as discussed previously in the six embodiments of the current invention.

All six embodiments of the current invention use movable doors in the third of four steps of the method of the current invention for visually enclosing riders inside the enclosing structure. There are other ways to visually enclose riders during the third step including, but not limited to, providing a passenger vehicle with a predetermined shape and size that prevents riders from looking back into the primary environment. Because platforms are moving during the third step, however, it is preferred to use movable doors not only for ensuring that the passenger vehicle is visually enclosed from the primary environment but also for safety. If a passenger or ride operator wandered near an open doorway of the enclosing structure during platform motion there could be a risk to their safety.

Ride paths of the ride tracks on all six embodiments of the current invention are all generally linear throughout the enclosing structure. It is recommended that ride paths or passenger vehicle displacements are generally linear throughout the enclosing structure so that riders are aware of their position relative to the primary environment. This is important as riders are only aware of their motion through the enclosing structure and not the motion of the enclosing structure itself. This helps creates the separation between the perceived final destination and the actual final destination. There is much flexibility in the method for paths to be varied, but users of the current invention will have to be sure those path constructions and vehicle displacements preserve this separation.

It was stated previously that the first step, second step, and third step of the method of the current invention are generally the same across all embodiments but with minor existing differences. Of these differences that were presented in this publication, one of particular importance is in the fourth step of the method. It should not escape the reader's attention that having the primary environment in the field of vision of the multiple of passengers of the passenger vehicle in the fourth step of the method could occur by different mechanisms. In this publication it occurred by simply moving the passenger vehicle into a visible primary environment, as well as by first moving the passenger vehicle into a non-visible primary environment and then making that primary environment visible (for example, having the lights low in the primary environment when entering so that it is not visible and then increasing the light intensity so that the primary environment becomes illuminated and visible to passengers). The important effect in the fourth step of the method is for the primary environment to at some point during the fourth step be in the field of vision of the passengers.

It should also be noted that the velocity of the passenger vehicle and the velocity of the enclosing structure during the third step of the method of the current invention can both vary greatly during the motion ride. The important distinction made in the claims and the examples of the current invention is that these two velocities vary at least once from one another during a period of time in the third step of the method so that separation of perceived fmal destination and actual final destination can occur. This also highlights the importance of the effect of separating perceived final destination and actual final destination and that such separation can vary greatly, as shown in the claims and the examples of the current invention, for horizontal, vertical, and combinations of horizontal and vertical displacements, for short or long lengths of displacements, and for short or long periods of time for passenger vehicles. It would then depend on the user of the current invention and their required needs for a predetermined intensity of effect of the current invention of creating an illusion of teleportation by predetermined accelerations, velocities, positions, and displacements of both the passenger vehicle and the enclosing structure.

It should further be noted that while all embodiments used a connecting and disconnecting ride track for moving the passenger vehicle into, through, and out of the enclosing structure, there are other possibilities. There are motion rides that don't use ride tracks (for example, motion rides that use automated guided vehicles) and there are passenger vehicles that move on ride tracks that are not connected to the ground (for example, ride tracks that are elevated for inverted ride tracks for passenger vehicles). Any of these mechanisms can be used as covered in the claims of the current invention and it is left to the preference of the user for how they desire to move passengers through a motion ride.

There are several possible ways to complete the four steps of the method of the current invention, as covered in the scope of the claims, for varying size, shape, and motion of the enclosing structure, manner for visually enclosing riders in the enclosing structure, and manner for moving the enclosing structure and riders during varying steps of the motion ride. Accordingly, the reader will see that the six embodiments, as presented in this publication, confirm the unique and effective method of the current invention for creating an exciting and intense ride effect of an illusion of teleportation ride event. Furthermore, while these embodiments use common apparatus found among modern motion rides, the four step method of the current invention is not exclusive to these apparatus. Other apparatus may be envisioned for operating the four step method as covered in the scope of the claims of the current invention. Thus the scope of the embodiments should be determined by the appended claims and their legal equivalents, rather than by the examples given.

What is claimed is:

1. A method for creating an illusion of teleportation on at least one of a passenger within a passenger vehicle comprising the steps of:

moving said passenger vehicle carrying least one of said passenger on a ride track and through a primary environment, said primary environment in the field of vision of least one of said passenger and said primary environment being an environment external to and surrounding a secondary environment;

moving said passenger vehicle carrying least one of said passenger on said ride track and out of said primary environment and into an opaque enclosing structure by access of at least one of multiple of an opaque movable door of said enclosing structure, said secondary environment being the environment inside of said enclosing structure;

moving said enclosing structure by at least one of a movable platform coupled to said enclosing structure for a predetermined amount of time with at least one of a predetermined structural velocity while said passenger vehicle carrying least one of said passenger is on said ride track and has at least one of a predetermined vehicular velocity not equal to least one of said predetermined structural velocity during said predetermined amount of time, said primary environment not in the field of vision of least one of said passenger and said secondary environment in the field of vision of least one of said passenger; and moving said passenger vehicle carrying least one of said passenger on said ride track and out of said secondary environment and into said primary environment by access of at least one of multiple of said movable door of said enclosing structure, said primary environment in the field of vision of least one of said passenger.

2. The method of claim 1, wherein said passenger vehicle is a ride vehicle.

3. The method of claim 1, wherein said enclosing structure is a movable passageway of a preconfigured shape and size with at least one capability of motion in a linear direction.

4. The method of claim 1, wherein said enclosing structure is a rotatable passageway of a preconfigured shape and size with at least one capability of motion in an angular direction around a central axis of rotation of said enclosing structure.

5. The method of claim 1, wherein said ride track is a connecting and disconnecting ride track.

6. The method of claim 1, wherein least one of said movable platform is at least one of a rotating platform.

7. The method of claim 1, wherein least one of said movable platform is at least one of a shifting platform.

8. The method of claim 1, wherein least one of said movable platform is at least one of a suspended platform.

9. The method of claim 1, wherein moving said enclosing structure by least one of said movable platform further includes moving said enclosing structure by a combination of least one of said movable platform selected from a group consisting of a rotating platform, a shifting platform, and a suspended platform.

10. A method for creating an illusion of teleportation on at least one of a passenger within a passenger vehicle comprising the steps of:

moving said passenger vehicle carrying least one of said passenger by first means through a primary environment, said primary environment in the field of vision of least one of said passenger and said primary environment being an environment external to and surrounding a secondary environment;

moving said passenger vehicle carrying least one of said passenger by said first means out of said primary environment and into an opaque enclosing structure by access of at least one of multiple of an opaque movable door of said enclosing structure, said secondary environment being the environment inside of said enclosing structure;

moving said enclosing structure by second means for a predetermined amount of time with at least one of a predetermined structural velocity while said passenger vehicle carrying least one of said passenger by said first means has at least one of a predetermined vehicular velocity not equal to least one of said predetermined structural velocity during said predetermined amount of time, said primary environment not in the field of vision of least one of said passenger and said secondary environment in the field of vision of least one of said passenger; and moving said passenger vehicle carrying least one of said passenger by said first means out of said secondary environment and into said primary environment by access of at least one of multiple of said movable door of said enclosing structure, said primary environment in the field of vision of least one of said passenger.

11. The method of claim 10, wherein said passenger vehicle is a ride vehicle.

12. The method of claim 10, wherein said enclosing structure is a movable passageway of a preconfigured shape and size with at least one capability of motion in a linear direction.

13. The method of claim 10, wherein said enclosing structure is a rotatable passageway of a preconfigured shape and size with at least one capability of motion in an angular direction around a central axis of rotation of said enclosing structure.

14. The method of claim 10, wherein said first means is a connecting and disconnecting ride track.

15. The method of claim 10, wherein said second means is a rotating platform.

16. The method of claim 10, wherein said second means is a shifting platform.

17. The method of claim 10, wherein said second means is a suspended platform.

18. The method of claim 10, wherein said second means is a combination of movable platforms selected from a group consisting of a rotating platform, a shifting platform, and a suspended platform.

19. A machine for creating an illusion of teleportation on at least one of a passenger of a motion ride comprising:

a passenger vehicle;

a connecting and disconnecting ride track with a fraction of track of predetermined sections coupled to the top of a movable platform, the connecting and disconnecting areas of said connecting and disconnecting ride track overlapping predetermined portions of edges of said movable platform; and an opaque enclosing structure with multiple of an opaque movable door, said enclosing structure connected on top of said movable platform and multiple of said movable door overlapping the connecting and disconnecting areas of said connecting and disconnecting ride track overlapping predetermined portions of edges of said movable platform;

whereby said enclosing structure defines the physical boundary between an external environment to said enclosing structure of a primary environment and an internal environment surrounded by said enclosing structure of a secondary environment; and whereby said passenger vehicle can move on said connecting and disconnecting ride track and into, through, and out of said enclosing structure by access of at least one of multiple of said movable door and said passenger vehicle become temporarily visually enclosed inside said enclosing structure by closing of at least one of multiple of said movable door during simultaneous motion of said passenger vehicle and motion of said enclosing structure by said movable platform as said passenger vehicle has at least one of a predetermined vehicular velocity and said enclosing structure has at least one of a predetermined structural velocity during a predetermined amount of time.

20. The machine of claim 19, wherein said machine creates an illusion of teleportation on least one of said passenger by a method comprising the steps of:

moving said passenger vehicle carrying least one of said passenger on said connecting and disconnecting ride track and through said primary environment, said primary environment in the field of vision of least one of said passenger;

moving said passenger vehicle carrying least one of said passenger on said connecting and disconnecting ride track and out of said primary environment and into said enclosing structure by access of at least one of multiple of said movable door of said enclosing structure;

moving said enclosing structure by said movable platform coupled to said enclosing structure for a predetermined amount of time with least one of said predetermined structural velocity while said passenger vehicle carrying least one of said passenger is on said connecting and disconnecting ride track and has least one of said predetermined vehicular velocity not equal to least one of said predetermined structural velocity during said predetermined amount of time, said primary environment not in the field of vision of least one of said passenger and secondary environment in the field of vision of least one of said passenger; and moving said passenger vehicle carrying least one of said passenger on said connecting and disconnecting ride track and out of said secondary environment and into said primary environment by access of at least one of multiple of said movable door of said enclosing structure, said primary environment in the field of vision of least one of said passenger.

* * * * *